US012228286B1

(12) United States Patent
Naik et al.

(10) Patent No.: US 12,228,286 B1
(45) Date of Patent: Feb. 18, 2025

(54) COMBUSTION SECTION WITH A PRIMARY COMBUSTION CHAMBER AND A SECONDARY COMBUSTION CHAMBER

(71) Applicant: GENERAL ELECTRIC COMPANY, Schenectady, NY (US)

(72) Inventors: Pradeep Naik, Bengaluru (IN); Hiranya Kumar Nath, Bengaluru (IN); Perumallu Vukanti, Bengaluru (IN); Clayton S. Cooper, Loveland, OH (US); Steven C. Vise, Loveland, OH (US); Michael A. Benjamin, Cincinnati, OH (US); R Narasimha Chiranthan, Bengaluru (IN)

(73) Assignee: General Electric Company, Evendale, OH (US)

( * ) Notice: Subject to any disclaimer, the term of this patent is extended or adjusted under 35 U.S.C. 154(b) by 0 days.

(21) Appl. No.: 18/477,597

(22) Filed: Sep. 29, 2023

(51) Int. Cl.
*F23R 3/28* (2006.01)
*F23R 3/34* (2006.01)
*F23R 3/50* (2006.01)

(52) U.S. Cl.
CPC ..... *F23R 3/346* (2013.01); *F23R 3/286* (2013.01); *F23R 3/50* (2013.01)

(58) Field of Classification Search
CPC .. F23R 3/343; F23R 3/346; F23R 3/34; F23R 3/52; F23R 3/50; F23R 425/58
See application file for complete search history.

(56) References Cited

U.S. PATENT DOCUMENTS

| | | | | |
|---|---|---|---|---|
| 2,607,191 | A | 8/1952 | Lee | |
| 4,192,139 | A | 3/1980 | Buchheim | |
| 4,893,475 | A | 1/1990 | Willis | |
| 5,121,597 | A | 6/1992 | Urushidani et al. | |
| 5,295,354 | A | 3/1994 | Barbier et al. | |
| 5,297,385 | A * | 3/1994 | Dubell | F23R 3/50 60/757 |
| 6,481,209 | B1 | 11/2002 | Johnson et al. | |
| 6,735,949 | B1 * | 5/2004 | Haynes | F23R 3/283 60/750 |
| 6,889,495 | B2 | 5/2005 | Hayashi et al. | |
| 8,656,721 | B2 | 2/2014 | Matsumoto et al. | |
| 8,991,189 | B2 | 3/2015 | Joshi et al. | |
| 9,080,772 | B2 | 7/2015 | Prociw et al. | |
| 10,222,066 | B2 | 3/2019 | Chen et al. | |

(Continued)

FOREIGN PATENT DOCUMENTS

| | | | |
|---|---|---|---|
| EP | 0499535 | A1 | 8/1992 |
| EP | 2236938 | A2 | 10/2010 |

*Primary Examiner* — Todd E Manahan
*Assistant Examiner* — Rodolphe Andre Chabreyrie
(74) *Attorney, Agent, or Firm* — McGarry Bair PC

(57) ABSTRACT

A combustion section of a turbine engine having a primary combustion chamber and a secondary combustion chamber. The primary combustion chamber is defined, at least in part, by a combustor liner and a dome wall. A primary fuel nozzle having an outlet is located at the dome wall, wherein the outlet of the primary fuel nozzle is fluidly coupled with the primary combustion chamber. At least one opening located in an outer liner axially aft of the dome wall fluidly couples the secondary combustion chamber and the primary combustion chamber. A set of secondary fuel nozzles are fluidly coupled with the secondary combustion chamber.

20 Claims, 12 Drawing Sheets

(56) References Cited

U.S. PATENT DOCUMENTS

| | | | | |
|---|---|---|---|---|
| 10,408,457 | B2 | 9/2019 | Akiyama et al. | |
| 10,436,450 | B2 | 10/2019 | Crawley et al. | |
| 11,313,561 | B2 | 4/2022 | Roh | |
| 2005/0034458 | A1 | 2/2005 | Burrus et al. | |
| 2017/0009993 | A1 | 1/2017 | Monahan et al. | |
| 2018/0149364 | A1 | 5/2018 | Berry | |
| 2019/0162414 | A1 | 5/2019 | Ogata et al. | |
| 2020/0378604 | A1* | 12/2020 | Roh | F23R 3/286 |
| 2022/0082258 | A1 | 3/2022 | Justice et al. | |
| 2023/0280035 | A1 | 9/2023 | Depperschmidt | |

* cited by examiner

COMBUSTION SECTION WITH A PRIMARY COMBUSTION CHAMBER AND A SECONDARY COMBUSTION CHAMBER

TECHNICAL FIELD

The present subject matter relates generally to a combustion section of a turbine engine, and more specifically to a combustion section with a primary combustion chamber and a secondary combustion chamber.

BACKGROUND

Turbine engines are driven by a flow of combustion gases passing through the engine to rotate a multitude of turbine blades, which, in turn, rotate a compressor to provide compressed air to the combustor for combustion. A combustor can be provided within the turbine engine and is fluidly coupled with a turbine into which the combusted gases flow.

The use of hydrocarbon fuels in the combustor of a turbine engine is known. Generally, air and fuel are fed to a combustion chamber, the air and fuel are mixed, and then the fuel is burned in the presence of the air to produce hot gas. The hot gas is then fed to a turbine where it cools and expands to produce power. By-products of the fuel combustion typically include environmentally unwanted by-products, such as nitrogen oxide and nitrogen dioxide (collectively called NOx), carbon monoxide (CO), unburned hydrocarbons (UHC) (e.g., methane and volatile organic compounds that contribute to the formation of atmospheric ozone), and other oxides, including oxides of sulfur (e.g., $SO_2$ and $SO_3$).

Varieties of fuel for use in combustion turbine engines are being explored. Hydrogen or hydrogen mixed with another element or compound can be used for combustion, however hydrogen or a hydrogen mixed fuel can result in a higher flame temperature than traditional fuels. That is, hydrogen or a hydrogen mixed fuel typically has a wider flammable range and a faster burning velocity than traditional fuels such as petroleum-based fuels, or petroleum and synthetic fuel blends.

Standards stemming from air pollution concerns worldwide regulate the emission of NOx. UHC, and CO generated as a result of the turbine engine operation. In particular, NOx is formed within the combustor as a result of high combustor flame temperatures during operation. It is desirable to decrease NOx emissions while still maintaining desirable efficiencies by regulating the temperature profile and or flame pattern within the combustor.

DETAILED DESCRIPTION

Figure 1:
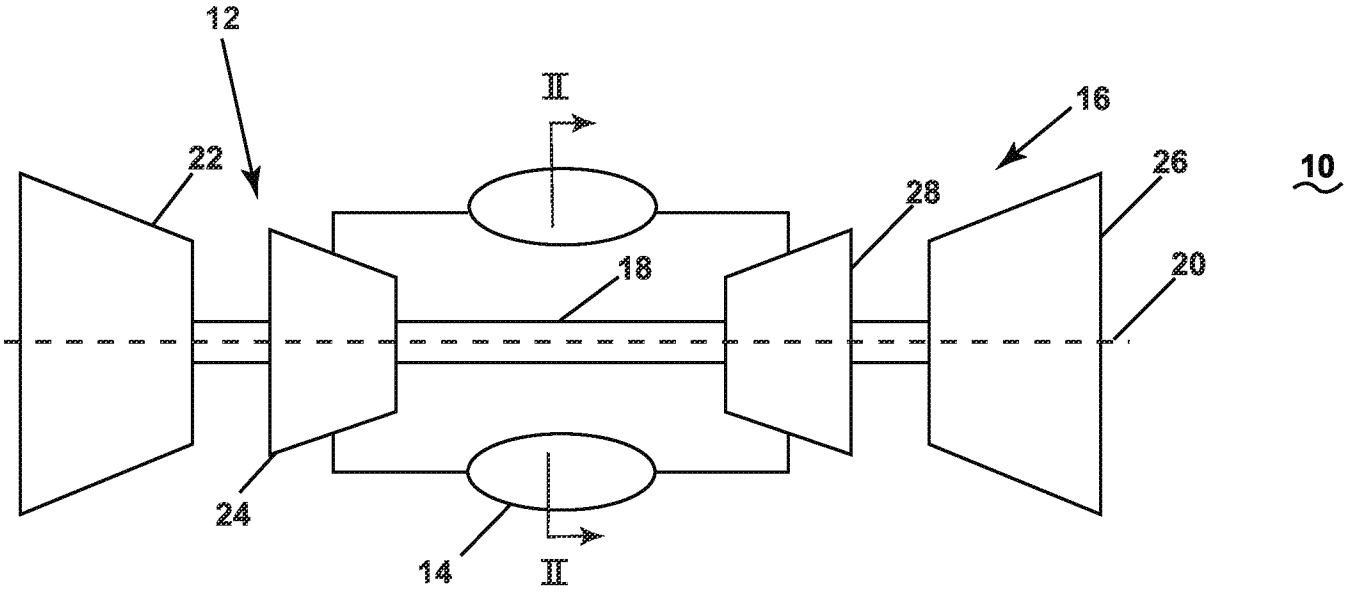
FIG. 1 is a schematic of a turbine engine.

Aspects of the disclosure described herein are directed to a combustion section, and in particular a combustion section with a primary combustor having a primary combustion chamber fluidly coupled to at least a primary fuel nozzle, and a set of secondary fuel nozzles. The set of secondary fuel nozzles can be fluidly coupled to a secondary combustion chamber, where the secondary combustion chamber is fluidly coupled to the primary combustion chamber at an opening in the outer liner. The set of secondary fuel nozzles can be arranged in multiple dimensions resulting in a cluster or array of fuel nozzles.

For purposes of illustration, the present disclosure will be described with respect to a turbine engine. It will be understood, however, that aspects of the disclosure described herein are not so limited and that a combustion section as described herein can be implemented in engines, including but not limited to turbojet, turboprop, turboshaft, and turbofan engines. Aspects of the disclosure discussed herein may have general applicability within non-aircraft engines having a combustor, such as other mobile applications and non-mobile industrial, commercial, and residential applications.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

As used herein, the terms "first", "second", "third", and "fourth" may be used interchangeably to distinguish one component from another and are not intended to signify location or importance of the individual components.

The terms "forward" and "aft" refer to relative positions within a gas turbine engine or vehicle, and refer to the normal operational attitude of the gas turbine engine or vehicle. For example, with regard to a gas turbine engine, forward refers to a position closer to an engine inlet and aft refers to a position closer to an engine nozzle or exhaust.

As used herein, the term "upstream" refers to a direction that is opposite the fluid flow direction, and the term "downstream" refers to a direction that is in the same direction as the fluid flow. The term "fore" or "forward" means in front of something and "aft" or "rearward" means behind something. For example, when used in terms of fluid flow, fore/forward can mean upstream and aft/rearward can mean downstream.

The term "fluid" may be a gas or a liquid. The terms "fluidly couples" and "fluidly coupled" mean that a fluid is capable of making the connection between the areas specified.

Additionally, as used herein, the terms "radial" or "radially" refer to a direction away from a common center. For example, in the overall context of a turbine engine, radial refers to a direction along a ray extending between a center longitudinal axis of the engine and an outer engine circumference.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) may be used for identification purposes to aid the reader's understanding of the present disclosure, and do not create limitations, particularly as to the position, orientation, or use of aspects of the disclosure described herein. Connection references (e.g., attached, coupled, connected, and joined) may be used and are to be construed broadly and can include intermediate structural elements between a collection of elements and relative movement between elements unless otherwise indicated. As such, connection references do not necessarily infer that two elements are directly connected and in fixed relation to one another. The exemplary drawings are for purposes of illustration only the dimensions, positions, order and relative sizes reflected in the drawings attached hereto can vary.

The singular forms "a", "an", and "the" include plural references unless the context clearly dictates otherwise. Furthermore, as used herein, the term "set" or a "set" of elements can be any number of elements, including only one.

As used herein, the term "array" is a two-dimensional ordered series or arrangement. That is an array has rows and columns that can be staggered or aligned in any desired pattern.

As used herein, the term "cluster" is a group of objects arranged in two dimensions closely together. By way of non-limiting example, a fuel nozzle cluster is a group of at least two fuel nozzles arranged together such that fuel nozzles in the cluster have a cluster distance between the fuel nozzles that is at least 5% less than the distance between a fuel nozzle in the cluster and a fuel nozzle not in the cluster.

FIG. 1 is a schematic view of a turbine engine 10. As a non-limiting example, the turbine engine 10 can be used within an aircraft. The turbine engine 10 can include, at least, a compressor section 12, a combustion section 14, and a turbine section 16. A drive shaft 18 rotationally couples the compressor section 12 and the turbine section 16, such that rotation of one affects the rotation of the other, and defines a rotational axis or a centerline 20 for the turbine engine 10.

The compressor section 12 can include a low-pressure (LP) compressor 22, and a high-pressure (HP) compressor 24 serially fluidly coupled to one another. The turbine section 16 can include an LP turbine 26, and an HP turbine 28 serially fluidly coupled to one another. The drive shaft 18 can operatively couple the LP compressor 22, the HP compressor 24, the LP turbine 26 and the HP turbine 28 together. Alternatively, the drive shaft 18 can include an LP drive shaft (not illustrated) and an HP drive shaft (not illustrated). The LP drive shaft can couple the LP compressor 22 to the LP turbine 26, and the HP drive shaft can couple the HP compressor 24 to the HP turbine 28. An LP spool can be defined as the combination of the LP compressor 22, the LP turbine 26, and the LP drive shaft such that the rotation of the LP turbine 26 can apply a driving force to the LP drive shaft, which in turn can rotate the LP compressor 22. An HP spool can be defined as the combination of the HP compressor 24, the HP turbine 28, and the HP drive shaft such that the rotation of the HP turbine 28 can apply a driving force to the HP drive shaft which in turn can rotate the HP compressor 24.

The compressor section 12 can include a plurality of axially spaced stages. Each stage includes a set of circumferentially-spaced rotating blades and a set of circumferentially-spaced stationary vanes. The compressor blades for a stage of the compressor section 12 can be mounted to a disk, which is mounted to the drive shaft 18. Each set of blades for a given stage can have its own disk. The vanes of the compressor section 12 can be mounted to a casing which can extend circumferentially about the turbine engine 10. It will be appreciated that the representation of the compressor section 12 is merely schematic and that there can be any number of stages. Further, it is contemplated, that there can be any other number of components within the compressor section 12.

Similar to the compressor section 12, the turbine section 16 can include a plurality of axially spaced stages, with each stage having a set of circumferentially-spaced, rotating blades and a set of circumferentially-spaced, stationary vanes. The turbine blades for a stage of the turbine section 16 can be mounted to a disk which is mounted to the drive shaft 18. Each set of blades for a given stage can have its own disk. The vanes of the turbine section 16 can be mounted to the casing in a circumferential manner. It is noted that there can be any number of blades, vanes and turbine stages as the illustrated turbine section is merely a schematic representation. Further, it is contemplated, that there can be any other number of components within the turbine section 16.

The combustion section 14 can be provided serially between the compressor section 12 and the turbine section 16. The combustion section 14 can be fluidly coupled to at least a portion of the compressor section 12 and the turbine section 16 such that the combustion section 14 at least partially fluidly couples the compressor section 12 to the turbine section 16. As a non-limiting example, the combustion section 14 can be fluidly coupled to the HP compressor 24 at an upstream end of the combustion section 14 and to the HP turbine 28 at a downstream end of the combustion section 14.

During operation of the turbine engine 10, ambient or atmospheric air is drawn into the compressor section 12 via a fan (not illustrated) upstream of the compressor section 12, where the air is compressed defining a pressurized air. The pressurized air can then flow into the combustion section 14 where the pressurized air is mixed with fuel and ignited, thereby generating combustion gases. Some work is extracted from these combustion gases by the HP turbine 28, which drives the HP compressor 24. The combustion gases are discharged into the LP turbine 26, which extracts additional work to drive the LP compressor 22, and the exhaust gas is ultimately discharged from the turbine engine 10 via an exhaust section (not illustrated) downstream of the turbine section 16. The driving of the LP turbine 26 drives the LP spool to rotate the fan (not illustrated) and the LP compressor 22. The pressurized airflow and the combustion gases can together define a working airflow that flows through the fan, compressor section 12, combustion section 14, and turbine section 16 of the turbine engine 10.

Figure 2:
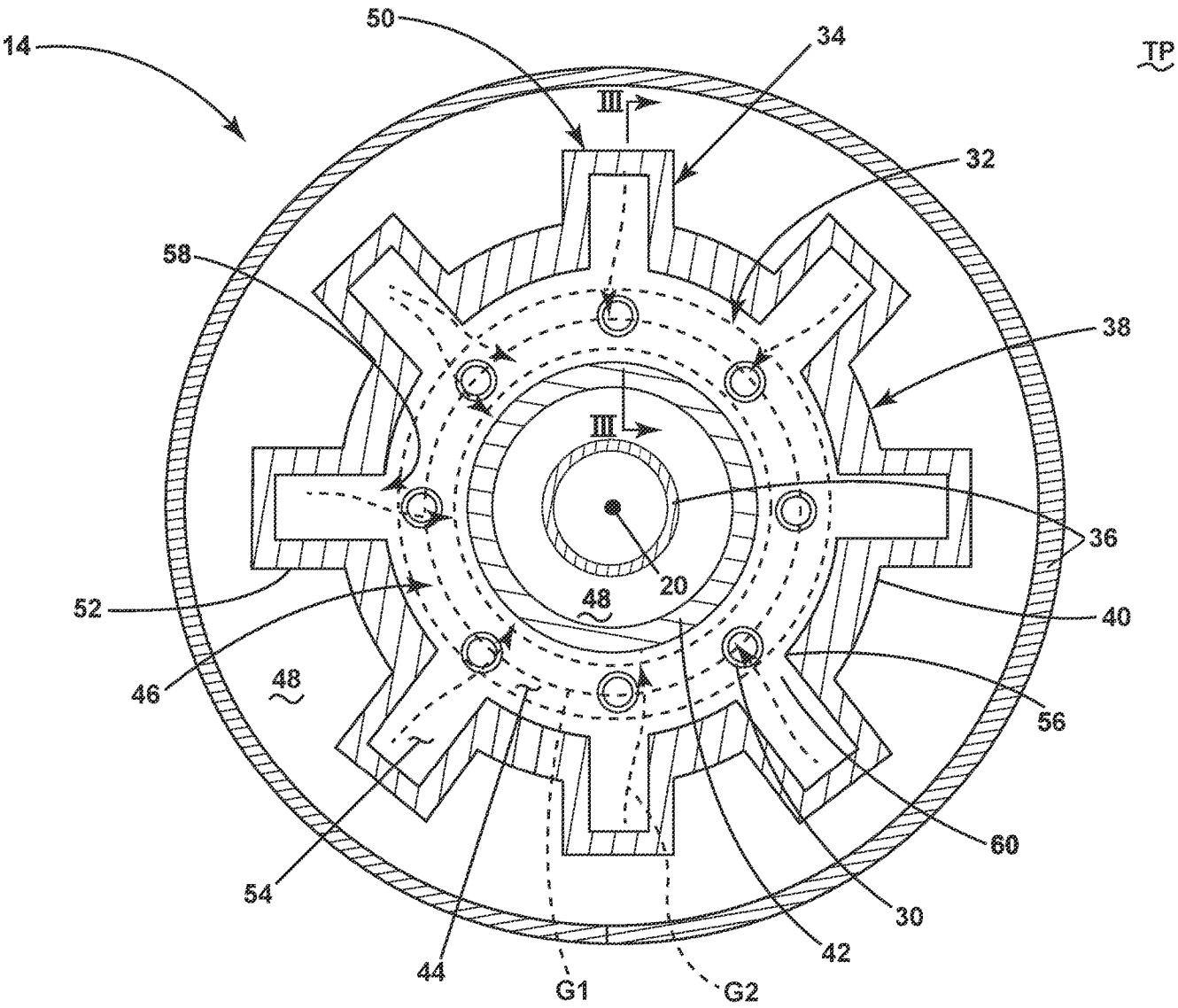
FIG. 2 depicts a cross-sectional view along line II-II of FIG. 1 of a combustion section of the turbine engine with a primary combustor and a set of secondary combustors.

FIG. 2 depicts a cross-sectional view of the combustion section 14 along line II-II of FIG. 1 defining a transverse plane (denoted "TP"). The combustion section 14 can include an annular arrangement of primary fuel nozzles 30 disposed around the centerline 20 of the turbine engine 10 (FIG. 1). Each of the primary fuel nozzles, illustrated by way of example as a set of primary fuel nozzles 30, are fluidly coupled to a primary combustor 32. It should be appreciated that the annular arrangement of fuel nozzles can be one or multiple fuel nozzles and one or more fuel nozzles of the set of primary fuel nozzles 30 can have different characteristics.

The primary combustor 32 can have a can, can-annular, or annular arrangement depending on the type of engine in which the primary combustor 32 is located. In a non-limiting example, an annular arrangement is illustrated and disposed within a casing 36. The primary combustor 32 is defined by a primary combustor liner 38 including an outer liner 40 and an inner liner 42 concentric with respect to each other and annular about the centerline 20. A dome wall 44 together with the primary combustor liner 38 define a primary combustion chamber 46 annular about the centerline 20. A compressed air passageway 48 can surround the primary combustor 32 and be at least partially defined by the casing 36.

The combustion section 14 further includes a set of secondary combustors 50 comprising a circumferential arrangement of discrete mini combustors 34. As used herein "mini" means that the component referenced with the term mini is smaller than the corresponding like component without the term mini (i.e., the discrete mini combustor 34 is smaller than the primary combustor 32). Each discrete mini combustor 34 in the set of secondary combustors 50 is defined by a secondary combustor liner 52. The secondary combustor liner 52 is illustrated, by way of example, as extending generally perpendicular from the primary combustor liner 38. The term "generally perpendicular" is defined as an angle equal to or between 85 degrees and 95 degrees. While illustrated as a 90-degree angle, it is contemplated that in a different and non-liming example, that the secondary combustor liner 52 can extend from the primary combustor liner 38 at any angle. It is further contemplated that each combustor of the set of secondary combustors 50 can correspond to a portion of the secondary combustor liner 52, where the angle between each portion of the secondary combustor liner 52 and the primary combustor liner 38 can vary.

The secondary combustor liner 52 defines at least a portion of a secondary combustion chamber illustrated, by way of example as a set of secondary combustion chambers 54 that are circumferentially spaced about the centerline 20. The set of secondary combustion chambers 54 extend from the outer liner 40 in a radially outward direction or direction away from the centerline 20. The set of secondary combustors 50 are fluidly coupled to the primary combustor 32 by at least one opening 58 extending through the outer liner 40. More specifically, each secondary combustion chamber of the set of secondary combustion chambers 54 terminates at an end 56 at the at least one opening 58 to define a secondary combustor outlet 60. In other words, the at least one opening 58 can be a plurality of openings where each secondary combustor of the set of secondary combustors 50 (circumferentially spaced) fluidly couples to the primary combustion chamber 46 at a corresponding opening 58 of the plurality of openings.

While illustrated as radially aligning with the primary fuel nozzle 30, the secondary combustor outlet 60 is axially downstream from the primary fuel nozzle 30. In other words, the primary fuel nozzle 30 and dome wall are axially forward (into the page) of the at least one opening 58 in the outer liner 40.

The primary combustor 32 produces primary exhaust gasses (denoted "G1") in the primary combustion chamber 46. The set of secondary combustors 50 produce secondary exhaust gasses (denoted "G2") in the set of secondary combustion chambers 54 that flows into the primary combustion chamber 46. The secondary exhaust gasses G2 circulate in the primary combustion chamber 46 reducing or starving $O_2$ levels. This results in a reduction of NOx emissions. The secondary exhaust gasses G2 can decrease the temperature in the primary combustion chamber 46, further reducing NOx emissions.

It should be understood that the mini combustor 34 can include a gradually converging body 96 (FIG. 3) as described herein. Further, the mini combustor 34 can have a constant area cross-section throughout as illustrated in FIG. 2. It is further contemplated that any combination of converging, diverging, constant combustor bodies, or any combination herein are considered.

Figure 3:
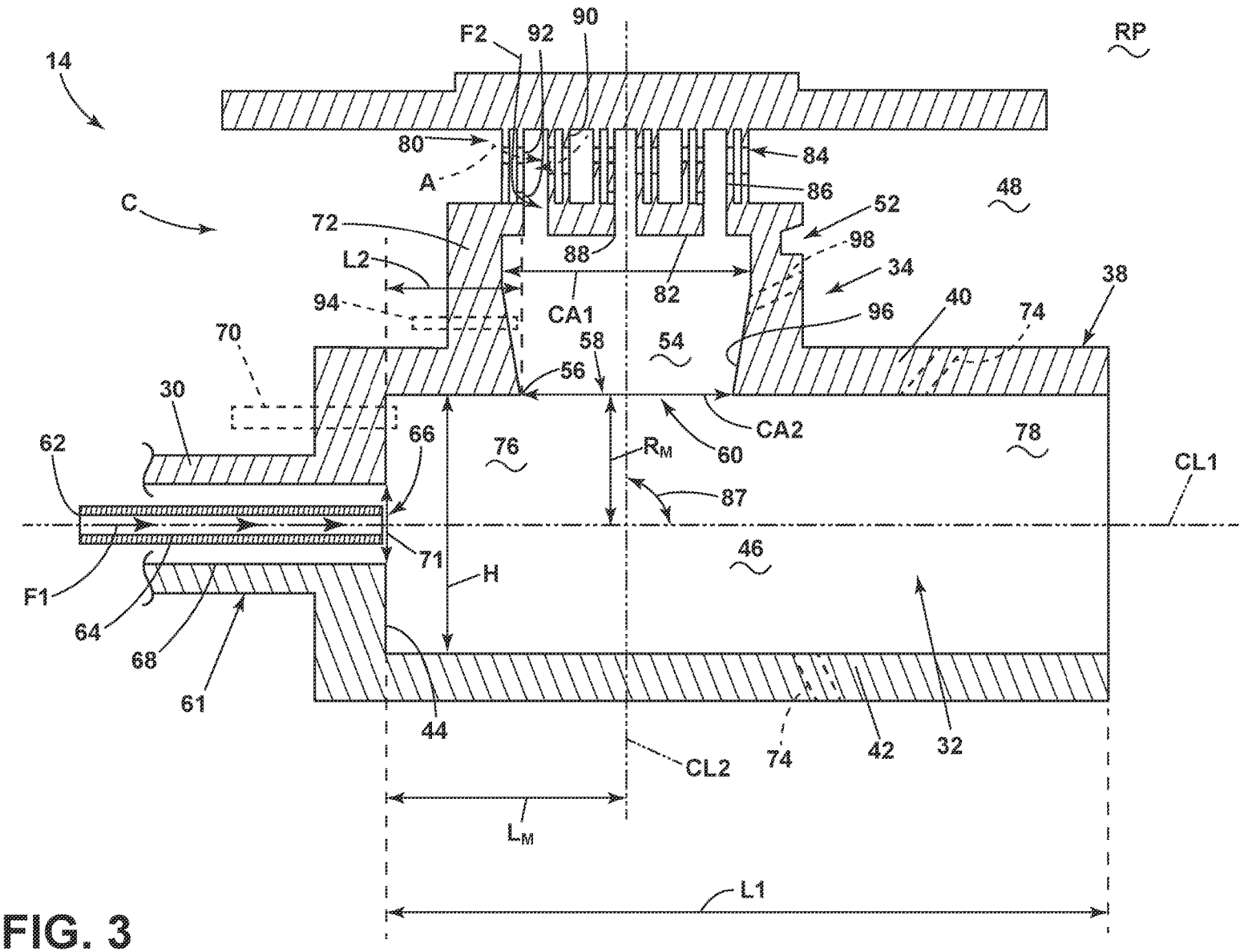
FIG. 3 depicts a schematic cross-sectional view taken along line III-III of FIG. 2 of the primary combustor and a secondary combustor of the set of secondary combustors.

FIG. 3 depicts a schematic cross-sectional view taken along line III-III of FIG. 2 illustrating the combustion section 14 as viewed in a radial plane (denoted "RP"). It can more clearly be seen that the mini combustor 34 is open to the primary combustor 32. The primary combustor 32 extends between the dome wall 44 and a primary combustor outlet 78 fluidly coupled to the turbine section 16 (FIG. 1).

A dome assembly 61 includes the dome wall 44 and houses the primary fuel nozzles 30. The primary fuel nozzle 30 can be fluidly coupled to a fuel inlet 62 via a fuel passageway 64 that can be adapted to receive a primary flow of fuel (denoted "F1"). The primary fuel nozzle 30 terminates in a fuel nozzle outlet also referred to herein as a dome inlet 66. In some implementations the primary fuel nozzle 30 can include a swirler 68 circumferentially arranged about the dome inlet 66. Optionally, a primary igniter 70 can be fluidly coupled to the primary combustion chamber 46.

A dome inlet diameter 71 is measured across the dome inlet 66. The dome inlet diameter 71 is illustrated, by way of example, as measured at the dome wall 44.

A backwall 72 extends radially from the end 56 to connect the secondary combustor liner 52 to the outer liner 40. The secondary combustor liner 52 terminates in the end 56 located downstream from the dome inlet 66.

Optionally, any number of dilution openings 74 can be located downstream from the mini combustor 34 in the outer liner 40 or the inner liner 42, or in both the outer liner 40 and the inner liner 42. It is contemplated that the primary combustor liner 38 is free of dilution openings at any location upstream from the mini combustor 34. Alternatively, in a different and non-limiting example, one or more dilution openings can be located axially between the dome inlet 66 and the mini combustor 34.

The mini combustor 34 includes a mini dome assembly 80 including a mini dome wall 82 and a set of secondary fuel nozzles 84. The set of secondary fuel nozzles 84 are illustrated, by way of example, as having multiple mixer tubes 86. Alternatively, in a different and non-limiting example, the set of secondary fuel nozzles 84 can include a swirler (not shown).

Each mixer tube of the multiple mixer tubes 86 includes a tube outlet 88. The set of mixer tubes 86 fluidly couple to the secondary combustion chamber 54 at the tube outlets 88.

Each mixer tube of the multiple mixer tubes 86 are defined by walls 90. A flow of fuel (denoted "F2") and an airflow (denoted "A") can be received by the multiple mixer tubes 86. The flow of fuel F2 and the airflow A received into one or more portions of the multiple mixer tubes 86 can be supplied through one or more openings 92 in walls 90. As illustrated, by way of example, each mixer tube of the multiple mixer tubes 86 can have opposing multiple air passages 92, where the flow of fuel F1 is injected in center of each mixer tube. The airflow A can be placed around the flow of fuel F1 to keep fuel away from the walls 90 of each mixer tube.

Optionally, a secondary igniter 94 is fluidly coupled to the secondary combustion chamber 54.

It is contemplated that the mini combustor 34 includes a gradually converging body 96. The gradually converging body 96 is defined as a portion of the mini combustor 34 where a first cross-sectional area (denoted "CA1") proximate the mini dome wall 82 is greater than a second cross-sectional area (denoted "CA2") proximate the secondary combustor outlet 60.

The fuel nozzle outlet or the dome inlet 66 defines a first centerline (denoted "CL1"). The opening 58 fluidly coupling the mini combustor 34 to the primary combustor 32 defines a second centerline CL2. As illustrated, by way of example, the first centerline CL1 and the second centerline CL2 overlap. That is, the first centerline CL1 and the second centerline CL2 intersect to define a first primary combustor angle 87 in the radial plane RP. The first primary combustor angle 87 can be 90° as illustrated. While illustrated as 90° the first primary combustor angle 87 can be in a range from 30° to 150°.

A primary combustor length (denoted "L1") is measured parallel to the first centerline CL1 between the dome wall 44 and the primary combustor outlet 78. A main combustion zone 76 is defined as the volume between the wall 44 and the second centerline CL2. A main combustion length (denoted "LM") is measured parallel to the first centerline CL1 from the dome wall 44 to the second centerline CL2. The main combustion length LM is from 5% to 90% of the primary combustor length L1. More specifically, the main combustion length LM can be in a range from 5% to 70%, 5% to 50%, or 5% to 40% of the primary combustor length L1.

A secondary combustor length (denoted "L2") is measured parallel to the first centerline CL1 between the dome wall 44 and the end 56. The primary combustion chamber 46 has a radial dimension extending from the outer liner 40 to inner liner 42 and referred to herein as a primary combustor height (denoted "H"). The primary combustor height H can be measured proximate the dome wall 44. The primary combustion height H is in a range from 1.1 to 10 times the dome inlet diameter 71.

The secondary combustor length L2 is in a range of 0% to 70% of the primary combustor length L1. More specifically, the secondary combustor length L2 can be in a range of 5% to 50% of the primary combustor length L1.

A radial distance (denoted "$R_M$") is defined as a radial dimension extending from the first centerline CL1 to the secondary combustor outlet 60. The radial distance $R_M$ varies from 0.5H to 1.0H. In other words, the radial distance $R_M$ measurement is in a range from 50% to 100% of the primary combustor height H.

During operation, compressed air (denoted "C") can be provided to the combustion section 14 from the compressor section 12 (FIG. 1) via the compressed air passageway 48. The compressed air C can be split between the primary combustor 32 and the set of secondary combustors 50, providing compressed air to the primary fuel nozzle 30 or swirler 68. The compressed air C can also form the airflow A provided to the multiple mixer tubes 86 via openings 92 in the walls 90. By way of non-limiting example, the primary combustor 32 can receive 50% to 90% of the compressed air C from the compressor section 12 while the set of secondary combustors 50 can receive between 10% and 50%.

Alternatively, in a different and non-limiting example, the primary combustor 32 can receive 60% to 90% of the compressed air C from the compressor section 12 while the set of secondary combustors 50 can receive between 10% and 40%. It is further contemplated that the primary combustor 32 can receive 70% to 90% of the compressed air C from the compressor section 12 while the set of secondary combustors 50 can receive between 10% and 30%.

Alternatively, in yet another different and non-limiting example, the primary combustor 32 can receive 10% to 50% of the compressed air C from the compressor section 12 while the set of secondary combustors 50 can receive between 50% and 90%. It is further contemplated that the primary combustor 32 can receive 10% to 40% of the compressed air C from the compressor section 12 while the set of secondary combustors 50 can receive between 60% and 90%.

Compressed air C can be fed into the primary fuel nozzle 30 and mixed with the primary flow of fuel F1 to define a primary fuel/air mixture. The primary fuel nozzle 30 can dispense a primary fuel/air mixture that is premixed or partially premixed. Further, the flow of fuel F1 can be a diffusion fuel free of an air mixture prior to entering the primary combustion chamber 46.

Fuel provided to the primary fuel nozzle 30 and the multiple mixer tubes 86 can include jet fuel natural gas or a more reacting fuel like hydrogen ($H_2$) and blends of $H_2$. In some implementations, the turbine engine 10 (FIG. 1) can be started on conventional fuel using the set of secondary combustors 50 where the secondary exhaust gasses G2 (FIG. 2) are propagated towards the primary combustion chamber 46 which can be fueled using conventional fuel or $H_2$ fuel.

When the secondary exhaust gasses G2 are directed towards the primary combustion chamber 46, the primary exhaust gasses G1 (FIG. 2) and the secondary exhaust gasses G2 mix which reduces $O_2$ levels in the primary combustion chamber 46 that reduces NOx emissions. Fuel staging between the primary combustion chamber 46 and the secondary combustion chamber 54 reduces the fuel/air ratio in these stages of the combustion section 14 which contributes to a further reduction in temperature and NOx emissions. In comparison a single staged combustor will have relatively higher fuel/air ratios and higher temperatures which leads to higher NOx emissions.

Optionally, a secondary set of dilution openings 98 can be provided in the secondary combustor liner 52 for connecting the compressed air passageway 48 and the secondary combustion chamber 54. The secondary set of dilution openings 98 can be at an aft location of the mini combustor 34 for trimming a combustor exit temperature profile and pattern factor associated with the mini combustor 34 and primary combustor 32.

By way of non-limiting example, the primary fuel nozzle 30 can be a rich cup having a swirler 68. A rich cup can have a fuel/air ratio higher than the stoichiometric ratio. The primary fuel nozzle 30 and at least the main combustion zone 76 can define a primary combustion system. When the primary fuel nozzle 30 is a rich cup then the primary combustion system can be a rich burn combustion system, where a rich burn combustion system includes an overall fuel/air ratio above the stoichiometric fuel/air ratio.

Alternatively, in a different and non-limiting example, the primary fuel nozzle 30 can be a lean cup and the primary combustion system can be a lean burn combustion system, where a lean burn combustion system includes an overall fuel/air ratio below the stoichiometric fuel/air ratio.

It is also contemplated that the primary fuel nozzle is controllable between fuel rich and fuel lean, such that the primary fuel nozzle 30 includes at least one cup that can be a rich cup or a lean cup depending on the controllable fuel supply.

The set of secondary fuel nozzles 84 and at least the secondary combustion chamber 54 can define a secondary combustion system. The set of secondary fuel nozzles 84 can include a flame that can be premixed, partially premixed, or diffused. The set of secondary fuel nozzles 84 include lean cups, rich cups, or a combination of lean cups and rich cups. The secondary combustion system can be a rich burn combustion system or a lean burn combustion system, depending on the overall fuel/air ratio of the set of secondary fuel nozzles 84 and resulting burn temperature. It is also contemplated that one or more of the multiple mixer tubes 86 defining the set of secondary fuel nozzles 84 can be a pilot tube. As used herein, the term "pilot tube" implies a richer fuel/air mixture. That is, a pilot tube is a mixer tube that receives more fuel per unit air than other mixer tubes in a set of mixer tubes. By way of non-limiting example, the additional fuel per unit air can be provided by one or more of: providing additional fuel to the mixer tube, incorporation of a swirler, where the air and the additional fuel are mixed via a swirler, or providing additional fuel via openings that circumscribing the tube outlet 88 of the pilot tube. While the pilot tube is considered richer than a lean mixer tube, it is contemplated that the pilot tube can be a rich cup or a lean cup.

The secondary combustion chamber 54 can be a set of circumferentially spaced secondary combustion chambers, as illustrated in FIG. 2. Each secondary combustion chamber 54 of the set of secondary combustion chambers can create its own secondary combustion system. That is, to break circumferential dynamics mode, some secondary combustion chambers can be made relatively fuel rich and others fuel lean.

It is contemplated that each secondary combustor of the set of secondary combustors is controllable between a rich burn combustion system and a lean burn combustion system. That is, during operation, each combustor of the set of secondary combustors can be controlled to be relatively fuel rich or relatively fuel lean.

When the primary combustion system is combined with the secondary combustion system, the secondary combustion system starves at least the primary combustion system of oxygen. This starvation or reduction of available oxygen to form NOx reduces NOx emissions from the primary combustion chamber 46.

The equivalence ratio (phi "Φ") of the primary combustion system or the secondary combustion system can be in a range from 0.4 to 2. When the primary combustion system and the secondary combustion system are lean burn combustion systems, the equivalence ratio (phi Φ) of the primary combustion system or the secondary combustion system can be in a range from 0.4 to 0.8. As used herein, equivalence ratio (phi "Φ") is defined as the ratio of the fuel-to-oxidizer ratio to the stoichiometric fuel-to-oxidizer ratio.

Figure 4:
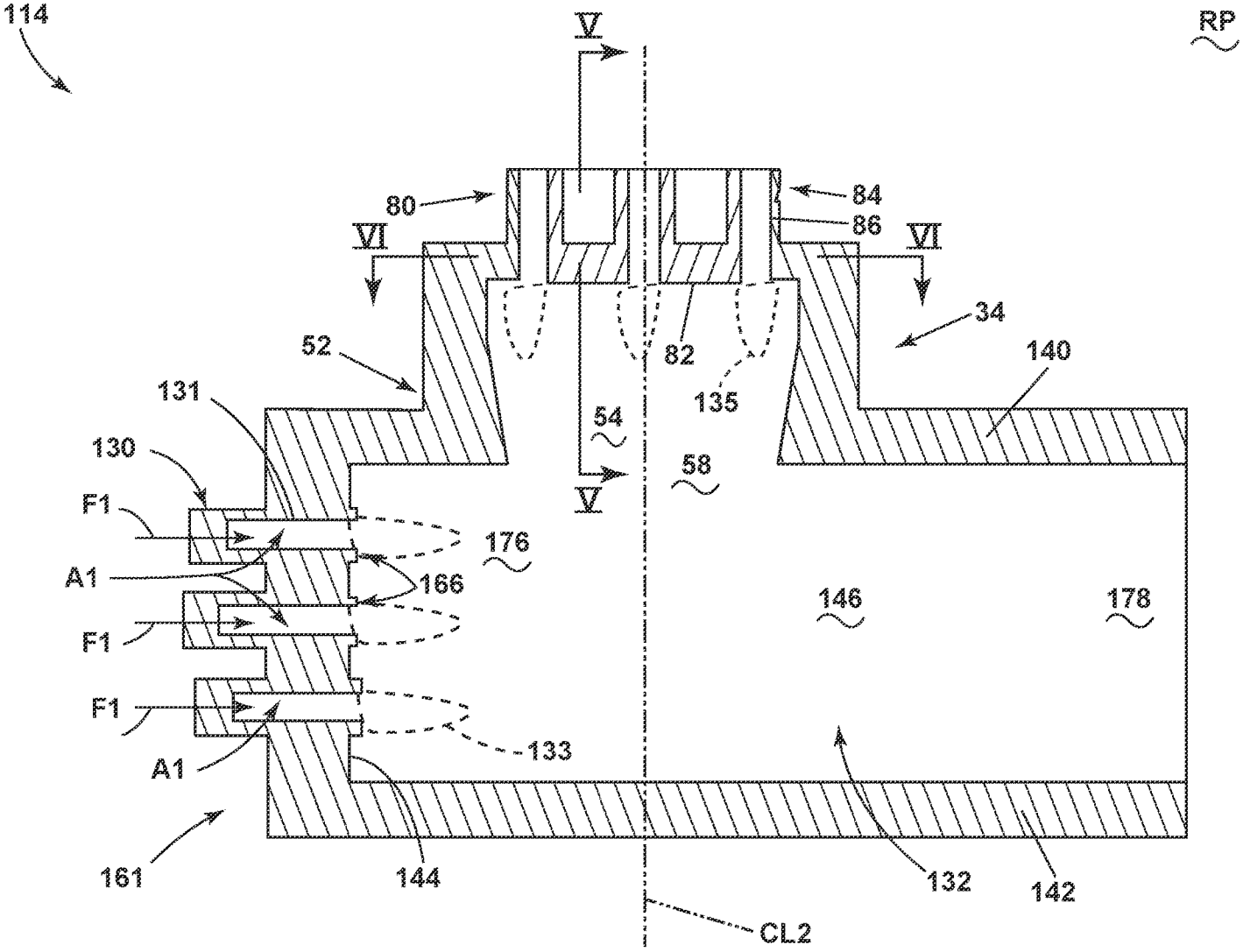
FIG. 4 is a cross-sectional view of another embodiment of a combustion section of FIG. 2 according to an aspect of the disclosure herein.

FIG. 4 depicts a cross-sectional view of another embodiment of a combustion section 114 as viewed in a radial plane (denoted "RP"). The combustion section 114 is similar to the combustion section 14 of FIG. 3; therefore, like parts will be identified with like numerals increased by 100, with it being understood that the description of the like parts of the combustion section 14 applies to the combustion section 114, except where noted.

A primary combustor 132 extends between a dome wall 144 and a primary combustor outlet 178 fluidly connected to the turbine section 16. An outer liner 140 is spaced radially from an inner liner 142 to define a primary combustion chamber 146 of the primary combustor 132. A dome assembly 161 includes the dome wall 144 and houses a set of primary fuel nozzles 130. The set of primary fuel nozzles 130 are illustrated, by way of example, as multiple primary mixer tubes 131. The multiple primary mixer tubes 131 can be adapted to receive a primary flow of fuel (denoted "F1") and a primary airflow A1. The set of primary fuel nozzles 130 can terminate in a set of fuel outlets, also referred to herein as a set of dome inlets 166.

A main combustion zone 176 is defined as the volume between the set of dome inlets 166 and the second centerline CL2 defined by the opening 58 of the discrete mini combustor 34 or the mini dome wall 82. During operation each fuel nozzle of the set of primary fuel nozzles 130 can include a flame 133 that can be premixed, partially premixed, or diffused. The set of primary fuel nozzles 130 can include lean cups, rich cups, or a combination of lean cups and rich cups. The set of primary fuel nozzles 130 and at least the main combustion zone 176 can define a primary combustion system. The primary combustion system can be a rich burn combustion system or a lean burn combustion system, depending on the overall fuel/air ratio of the set of primary fuel nozzles 130 and resulting burn temperature. It is contemplated that one or more of the multiple primary mixer tubes 131 of the set of primary fuel nozzles 130 can be a pilot tube. The set of primary fuel nozzles 130 are illustrated as having three fuel nozzles when viewed in the radial plane RP, however, any number of fuel nozzles are contemplated.

The secondary combustion chamber 54 is defined by the secondary combustor liner 52 and the mini dome wall 82. The secondary combustion chamber 54 fluidly couples to the primary combustion chamber 146 at the opening 58 of the outer liner 140. During operation each fuel nozzle of the set of secondary fuel nozzles 84 can include flames 135 that can be premixed, partially premixed, or diffused. The multiple mixer tubes 86 can be lean cups, rich cups, or a combination of lean cups and rich cups. It is also contemplated that one or more of the multiple mixer tubes 86 can be a pilot tube. By way of non-limiting example, the multiple mixer tubes 86 can be lean and the flames 135 can be a cluster or array of micro flames.

The set of secondary fuel nozzles 84 are illustrated as having three fuel nozzles when viewed in the radial plane RP, however, any number of fuel nozzles are contemplated.

The primary combustion system and the secondary combustion system of the combustion section 114 can be lean burn combustion systems. It is contemplated that while the primary combustion system and the secondary combustion system are lean burn combustion systems, one or more fuel nozzles of the set of primary fuel nozzles 130, or one or more fuel nozzles of the set of secondary fuel nozzles 84 can be a rich cup or a pilot tube.

Alternatively, in a different and non-limiting example, the primary combustion system can be a rich burn combustion system. It is further contemplated that while the primary combustion system is a rich burn combustion system, the set of primary fuel nozzles 130 can include lean cups and rich cups.

Alternatively, in yet another different and non-limiting example, the secondary combustion system can be a rich burn combustion system. It is further contemplated that while the secondary combustion system is a rich burn combustion system, the set of primary fuel nozzles 130 can include lean cups and rich cups.

Figure 5:
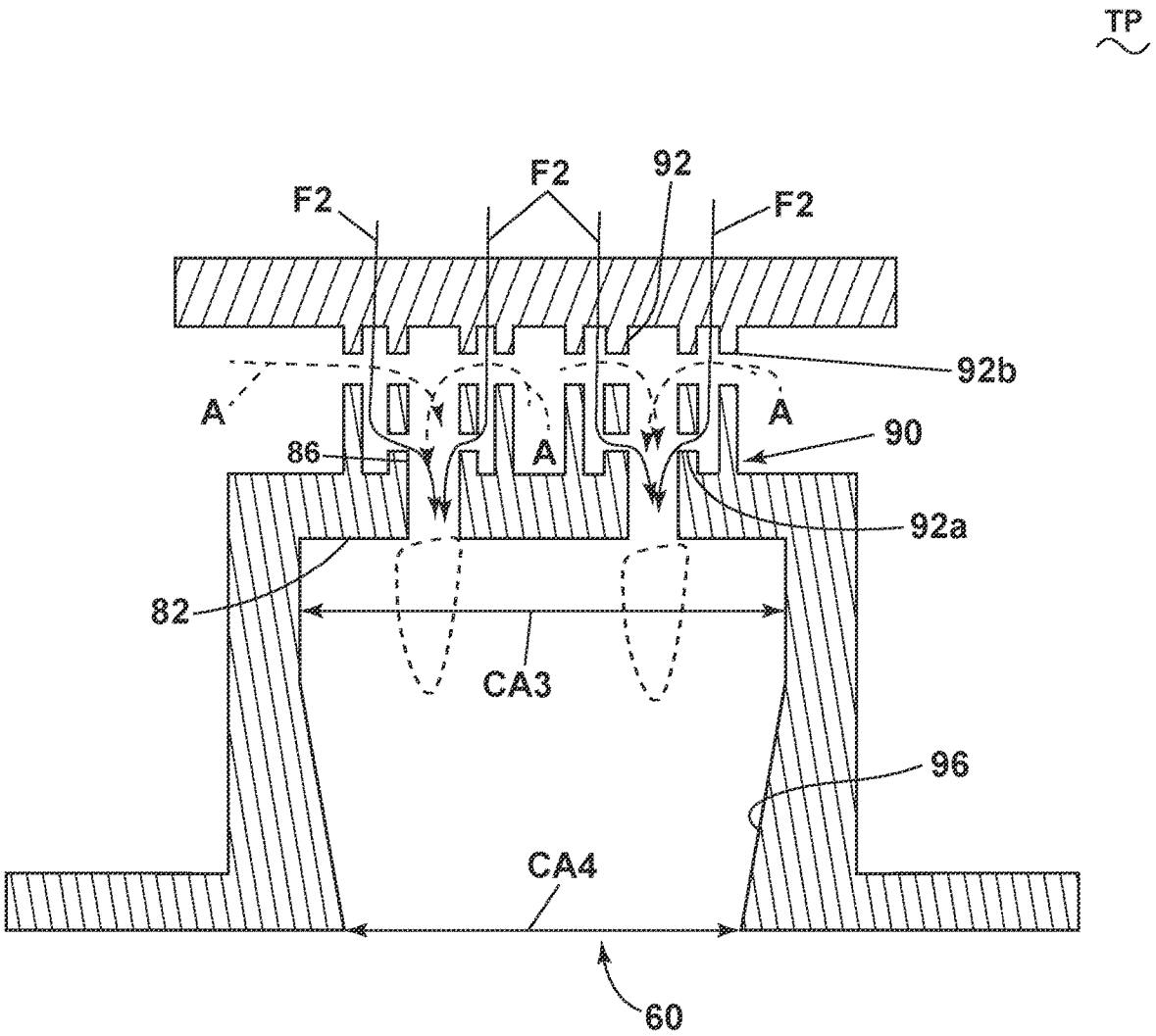
FIG. 5 is a schematic cross-sectional view along line V-V of FIG. 4 of the secondary combustor according to an aspect of the disclosure herein.

FIG. 5 depicts a cross-sectional view of the combustion section 114 along line V-V of FIG. 4 in a parallel transverse plane TP to that illustrated in FIG. 2. Each mixer tube of the multiple mixer tubes 86 are defined by walls 90. The flow of fuel F2 and the airflow A can be received by the multiple mixer tubes 86. The fuel F2 can be received into each mixer tube of the multiple mixer tubes 86 from one or more fuel openings 92*a* in the walls 90 that define the mixer tube. Further the airflow A (a portion of the compressed airflow C (FIG. 3) is received into one or more portions of the multiple mixer tubes 86 being supplied through one or more air openings 92*b* in walls 90.

As illustrated, by way of example, the gradually converging body 96 can be gradually converging in the transverse plane TP as well as the radial plane RP (FIG. 4). A third cross-sectional area (denoted "CA3") proximate the mini dome wall 82 is greater than a fourth cross-sectional area (denoted "CA4") proximate the secondary combustor outlet 60.

Alternatively, in a different and non-limiting example, the gradually converging body 96 can gradually converge as viewed by a single plane. Further, in yet another different and non-limiting example, the mini combustor 34 can have a constant area cross-section throughout. It is further contemplated that any combination of converging, diverging, constant combustor bodies, or any combination herein are considered.

The set of secondary fuel nozzles 84 are illustrated as having two fuel nozzles when viewed in the transverse plane TP, however, any number of fuel nozzles are contemplated. More specifically, the set of secondary fuel nozzles 84 can include at least two or more nozzles located or viable in the radial plane RP or the transverse plane TP.

Figure 6:
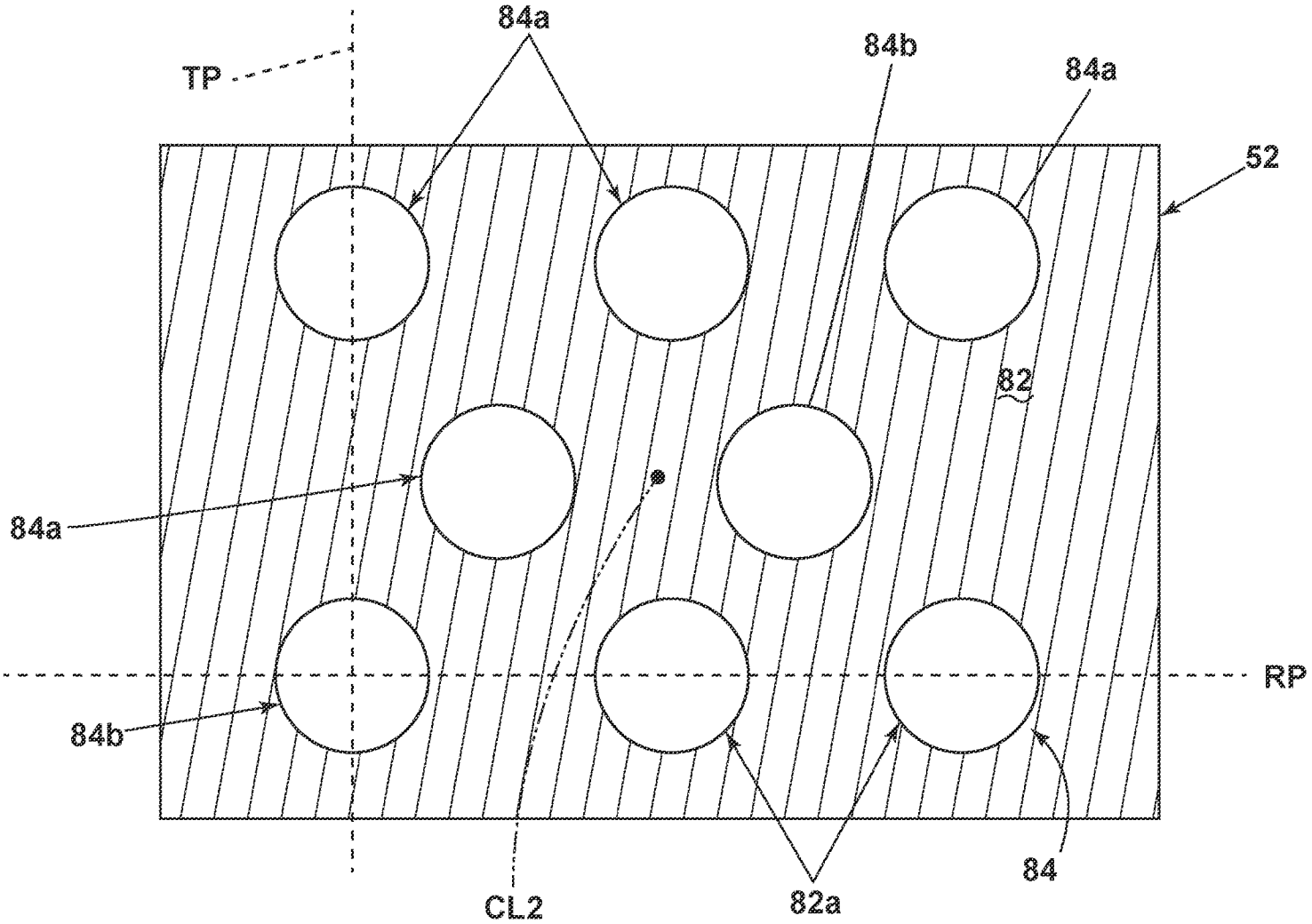
FIG. 6 is a schematic cross-sectional view along line VI-VI of FIG. 4 at a mini dome wall of the secondary combustor according to an aspect of the disclosure herein.

FIG. 6 depicts a cross-sectional view of the combustion section 114 along line VI-VI at the mini dome wall 82 coupled to the secondary combustor liner 52 of FIG. 4. FIG. 6 further illustrates the set of secondary fuel nozzles 84, showing how the set of secondary fuel nozzles are arranged in an array or a cluster of fuel nozzles 84*a*, 84*b*. By way of example, the illustrated eight fuel nozzles 84*a*, 84*b* can be arranged in rows and columns where the rows or columns can have a varying number of fuel nozzles. In other words, the set of secondary fuel nozzles 84 can be staggered in at least two dimensions. That is, the set of secondary fuel nozzles 84 can include multiple fuel nozzles visible in more than one plane that form a cluster or an array. While illustrated as eight fuel nozzles 84*a*, 84*b*, the set of secondary fuel nozzles 84 can include any number of fuel nozzles. More specifically, the set of secondary fuel nozzles 84 can include two or more fuel nozzles.

Orientating the set of secondary fuel nozzles 84 as a cluster of fuel nozzles 84*a*, 84*b* provides a temperature control advantage. The cluster of fuel nozzles 84*a*, 84*b* can also provide a desired temperature gradient. The fuel/air mixture of each mixer tube of the multiple mixer tubes 86 (FIG. 5) can be individually selected or controlled. That is, one or more of the fuel nozzles can have the same or different fuel/air mixture. It is also contemplated that the fuel/air mixture of each mixer tube of the multiple mixer tubes 86 (FIG. 5) can be controlled during operation.

By way of non-limiting example, the fuel nozzles 84*a*, illustrated as a first subset of the secondary fuel nozzles 84 that make up a portion of the array or the cluster, can be lean cups. The fuel nozzles 84*b*, illustrated as a second subset of the secondary fuel nozzles 84 that make up a portion of the array or the cluster, can be a pilot tube or a rich cup. While illustrated as two fuel nozzles 84*b*, any number of secondary fuel nozzles 84 can form the second subset of fuel nozzles 84*b*.

It is contemplated that the fuel/air mixture of each secondary fuel nozzle of the set of secondary fuel nozzles 84 can be controlled such that a lean cup can become a rich cup or a pilot tube. It is further contemplated that the fuel/air mixture of each secondary fuel nozzle of the set of secondary fuel nozzles 84 can be controlled such that a rich cup or pilot tube can become a lean cup.

The second centerline CL2, generally perpendicular to the mini dome wall 82, is illustrated, by way of example, in the middle of the set of secondary fuel nozzles 84. In other words, the second centerline CL2 is located at the geometric center point of the cluster of the set of secondary fuel nozzles 84. Alternatively, other locations of the intersection of the second centerline CL2 and the mini dome wall 82 are contemplated.

Figure 7:
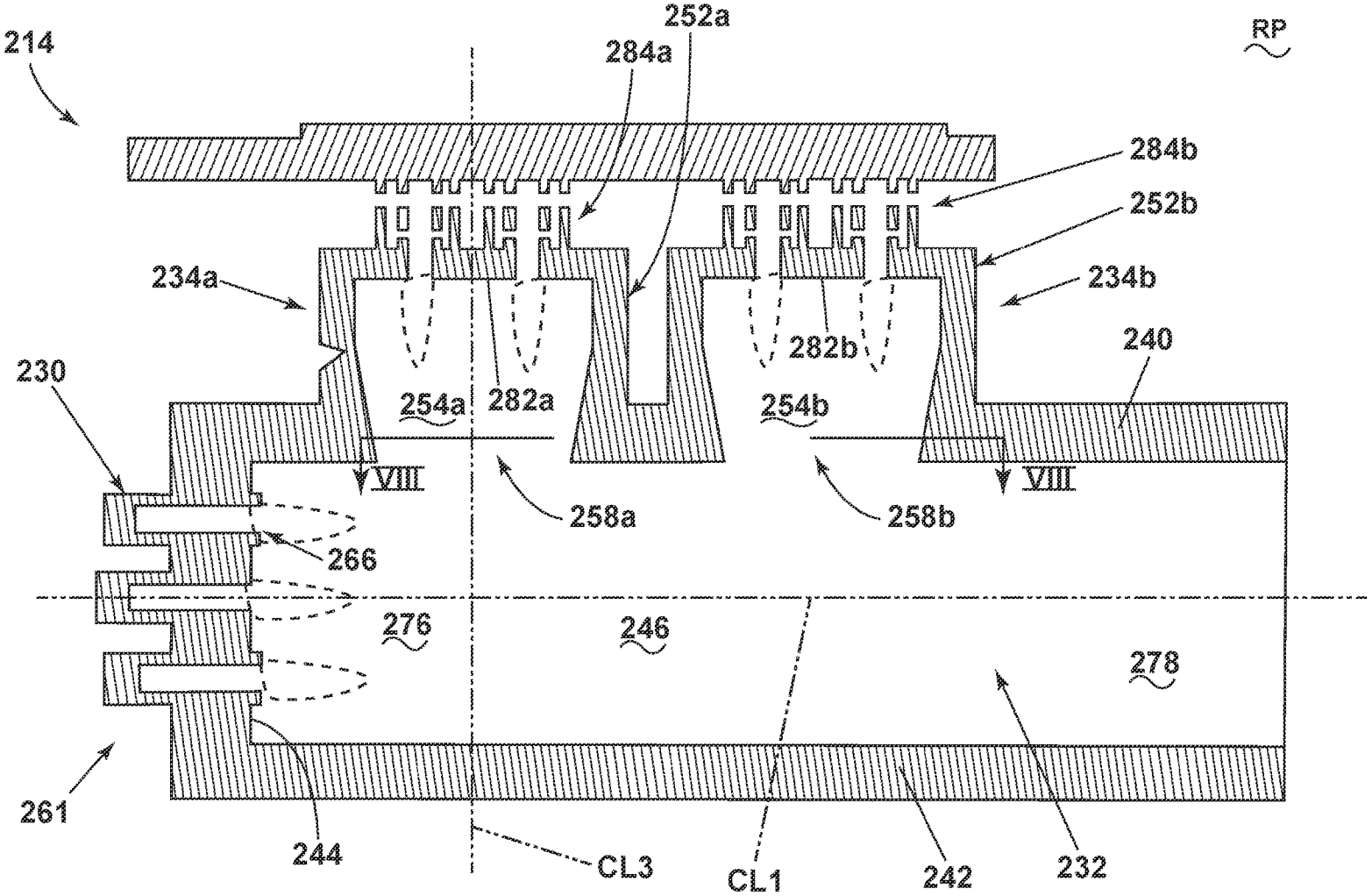
FIG. 7 is a schematic cross-sectional view of yet another embodiment of a combustion section of FIG. 2 according to an aspect of the disclosure herein.

FIG. 7 depicts a cross-sectional view of yet another embodiment of a combustion section 214 as viewed in a radial plane (denoted "RP"). The similar combustion section 214 is similar to the combustion section 114 of FIG. 4, therefore, like parts will be identified with like numerals further increased by 100, with it being understood that the description of the like parts of the combustion section 114 apply to the combustion section 214, except where noted.

A primary combustor 232 extends between a dome wall 244 and a primary combustor outlet 278 fluidly connected to the turbine section 16. An outer liner 240 is spaced radially from an inner liner 242 to define a primary combustion chamber 246 of the primary combustor 232. A dome assembly 261 includes the dome wall 244 and houses a set of primary fuel nozzles 230. The set of primary fuel nozzles 230 includes a set of fuel outlets 266. The set of fuel outlets 266 define a first centerline (denoted "CL1").

The combustion section 214 includes a set of secondary combustion chambers illustrated, by way of example as a forward secondary combustion chamber 254*a* and an aft secondary combustion chamber 254*b*. The forward secondary combustion chamber 254*a* can be one discrete combustion chamber of a set of discrete, circumferentially spaced forward secondary combustion chambers. The aft secondary combustion chamber 254*b* can be one combustion chamber of a set of discrete, circumferentially spaced aft secondary combustion chambers having axially spaced circumferential centerlines from circumferential centerlines of the forward secondary combustion chambers.

The forward secondary combustion chamber 254*a* is defined by a forward secondary combustor liner 252*a* and a forward mini dome wall 282*a*. A forward set of secondary fuel nozzles 284*a* are coupled to or are received by the forward mini dome wall 282*a*. A forward opening 258*a* in the outer liner 240 fluidly couples the forward secondary combustion chamber 254*a* to the primary combustion chamber 246.

The aft secondary combustion chamber 254*b* is defined by an aft secondary combustor liner 252*b* and an aft mini dome wall 282*b*. An aft set of secondary fuel nozzles 284*b* are coupled to or are received by the aft mini dome wall 282*b*. An aft opening 258*b* in the outer liner 240 fluidly couples the aft secondary combustion chamber 254*b* to the primary combustion chamber 246.

A main combustion zone 276 can be defined as the volume between the set of fuel outlets 266 of the set of primary fuel nozzles 230, and a forward centerline CL3 defined by the forward opening 258*a* in the outer liner 240 located at an exit of a forward discrete mini combustor 234*a*. The set of primary fuel nozzles 230 can include lean cups, rich cups, or a combination of lean cups and rich cups. The set of primary fuel nozzles 230 and at least the main combustion zone 276 can define a primary combustion system. The primary combustion system can be a rich burn combustion system or a lean burn combustion system, depending on the overall fuel/air ratio of the set of primary fuel nozzles 230 and resulting burn temperature.

A forward secondary combustion system can be defined by the forward secondary combustion chamber 254*a* and the forward set of secondary fuel nozzles 284*a*. The forward set of secondary fuel nozzles 284*a* can include lean cups, rich cups, pilot tubes, or a combination of lean cups and rich cups. The forward secondary combustion system can be a rich burn combustion system or a lean burn combustion system, depending on the overall fuel/air ratio of the forward set of secondary fuel nozzles 284*a* and resulting burn temperature.

An aft secondary combustion system can be defined by the aft secondary combustion chamber 234*b* and the aft set of secondary fuel nozzles 284*b*. The aft set of secondary fuel nozzles 284*b* can include lean cups, rich cups, pilot tubes, or a combination of lean cups and rich cups. The forward secondary combustion system can be a rich burn combustion system or a lean burn combustion system, depending on the overall fuel/air ratio of the aft set of secondary fuel nozzles 284*b* and resulting burn temperature.

While illustrated as the same size, the forward secondary combustion chamber 254*a* and the aft secondary combustion chamber 254*b* can have different volumes or cross-sectional shapes. Further, one of the forward secondary combustion chamber 254*a* or aft secondary combustion chamber 254*b* can be an annular combustion chamber (see FIG. 10). It is also contemplated that the forward set of secondary fuel nozzles 284*b* or the aft set of secondary fuel nozzles 284*b* can include any number of fuel nozzles.

Figure 8:
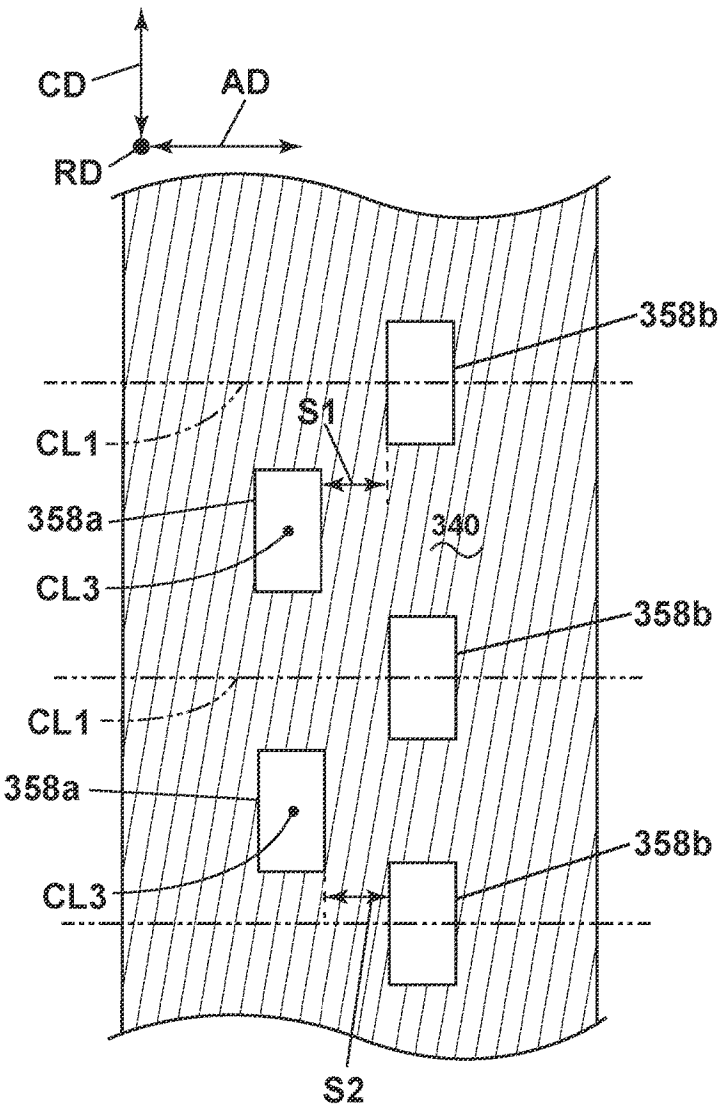
FIG. 8 is a schematic cross-sectional view along line VIII-VIII of FIG. 7 of a portion of an outer liner of the primary combustion section from FIG. 7 according to an aspect of the disclosure herein.

FIG. 8 is a schematic of a portion of the outer liner 240 as seen from line VIII-VIII in FIG. 7. An axial direction (denoted "AD") extends parallel to the centerline 20 (FIG. 1), a radial direction (denoted "RD") extends into the page and perpendicular to the axial direction AD, and a circumferential direction (denoted "CD") is perpendicular to both the radial and axial directions RD, AD. The circumferential direction CD circumscribes the engine centerline 20 (FIG. 1) and extends up and down the page when oriented in two dimensions as illustrated.

The forward opening 258*a* can be a set of forward openings 258*a* where each forward opening corresponds to a discrete circumferentially spaced forward secondary combustion chamber. Each of the forward openings 258*a* of the set of forward openings 258*a* includes a corresponding forward centerline CL3.

The aft opening 258*b* can be a set of aft openings 258*b* where each aft opening corresponds to a discrete circumferentially spaced aft secondary combustion chamber. As illustrated, by way of example, the set of aft openings 258*b* are spaced from the set of forward openings 258*a* in the axial direction AD. As illustrated, by way of example, the set of forward openings 258*a* and the set of aft openings 258*b* axially align. While illustrated as completely aligned, it is contemplated that at least a portion of the set of aft openings 258*b* axially align with at least a portion of the set of forward openings 258*a*.

As illustrated, by way of example, the first centerline CL1 can pass through at least a portion of the forward opening 258*a* or the aft opening 258*b*. It is contemplated that the first centerline CL1 can intersect the third centerline CL3.

Alternatively, in a different and non-limiting example, the forward opening 258*a* and the aft opening 258*b* can be located in the circumferential direction CD in such a way that the first centerline CL1 does not align or pass through any portion of the forward opening 258*a* and the aft opening 258*b*.

Figure 9:
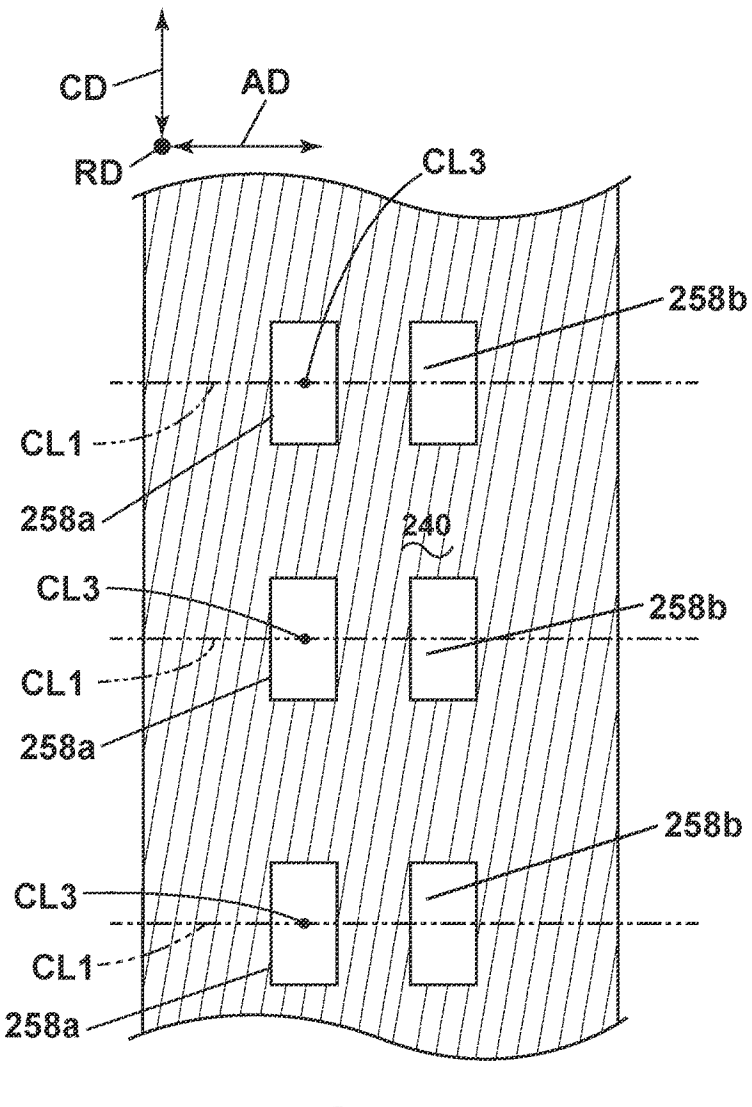
FIG. 9 is a schematic cross-sectional view of another embodiment of a portion of the outer liner of the primary combustion section from FIG. 7 according to an aspect of the disclosure herein.

FIG. 9 depicts a schematic cross-sectional view of another embodiment of a portion of an outer liner 340 similar to the portion of the outer liner 240 of FIG. 8, therefore, like parts will be identified with like numerals further increased by 100, with it being understood that the description of the like parts of the portion of the outer liner 240 apply to the portion of the outer liner 340, except where noted.

At least one forward opening can be a set of forward openings 358*a* where each forward opening corresponds to a discrete circumferentially spaced forward secondary combustion chamber. Each of the forward openings of the set of forward openings 358*a* can include a corresponding forward centerline CL3.

An aft opening can be a set of aft openings 358*b* where each aft opening corresponds to a discrete circumferentially spaced aft secondary combustion chamber. As illustrated, by way of example, the set of aft openings 358*b* are spaced from the set of forward openings 358*a* in the axial direction AD. As illustrated, by way of example, the set of forward openings 358*a* and the set of aft openings 358*b* axially offset from each other.

As illustrated, by way of example, the third centerline CL3 is located between adjacent first centerlines CL1.

A first axial distance (denoted "S1") can be measured in the axial direction AD between one of the forward openings 358*a* and one of the aft openings 358*b*. As illustrated by a second axial distance (denoted "S2"), the axial distance between the forward openings 358*a* and the aft openings 358*b* can be equal, however it is contemplated in a different and non-limiting example, that the first axial distance S1 and the second axial distance S2 can be different.

Figure 10:
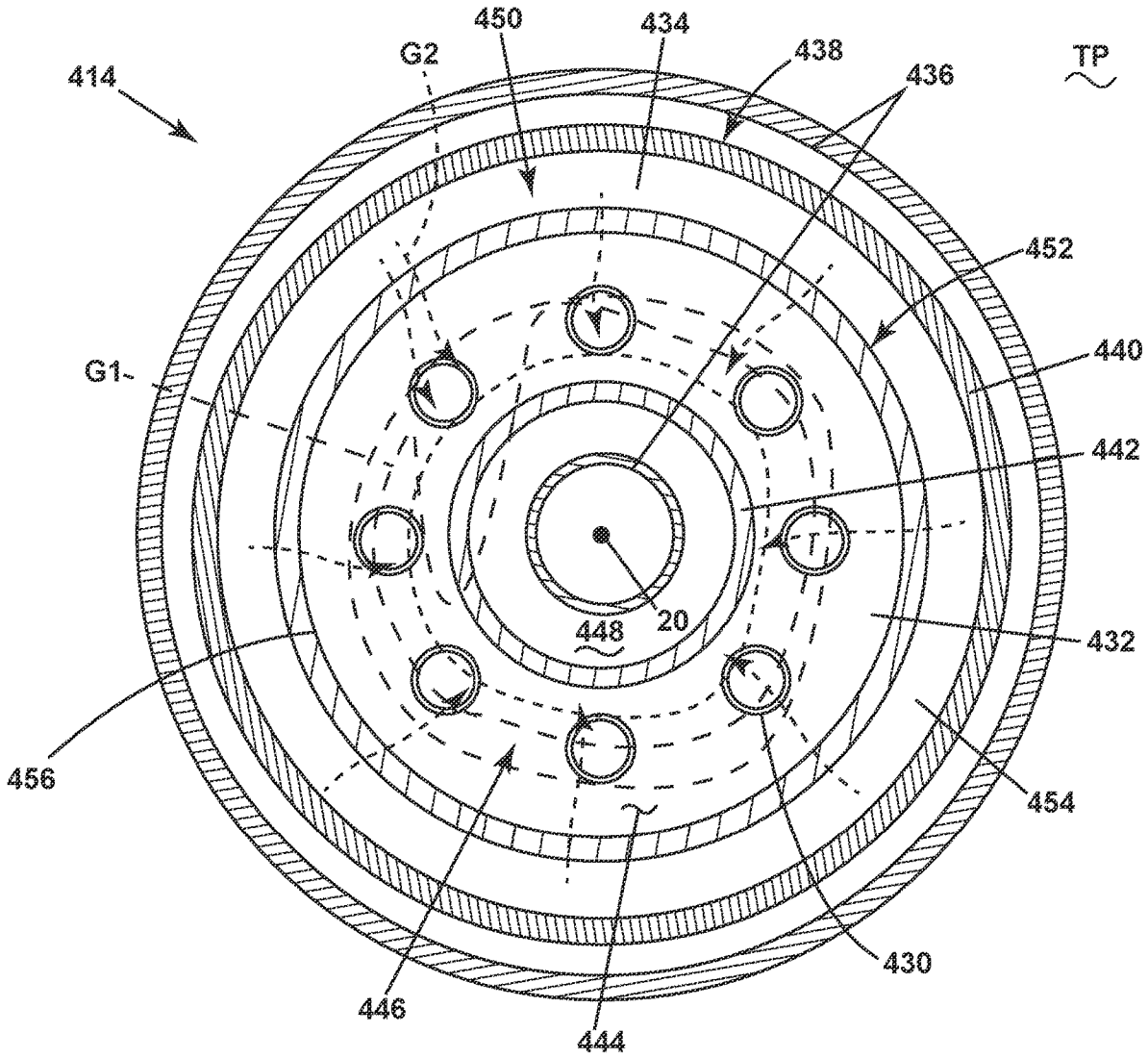
FIG. 10 is a schematic cross-sectional view of another embodiment of a combustion section of the turbine engine of FIG. 1 with a primary combustor and a set of secondary combustors according to an aspect of the disclosure herein.

FIG. 10 depicts a cross-sectional view of another embodiment of a combustion section 414 as viewed in a transverse plane (denoted "TP"). The combustion section 414 includes an annular arrangement of primary fuel nozzles 430 disposed around the centerline 20 of the turbine engine 10 (FIG. 1). Each of the primary fuel nozzles 430 are fluidly coupled to a primary combustor 432. It should be appreciated that the annular arrangement of fuel nozzles can be one or multiple fuel nozzles and one or more of the primary fuel nozzles 430 can have different characteristics. The primary combustor 432 can have a can, can-annular, or annular arrangement depending on the type of engine in which the primary combustor 432 is located. In a non-limiting example, an annular arrangement is illustrated and disposed within a casing 436. The primary combustor 432 is defined by a primary combustor liner 438 including an outer liner 440 and an inner liner 442 concentric with respect to each other and annular about the centerline 20. A dome wall 444 together with the primary combustor liner 438 define a primary combustion chamber 446 annular about the centerline 20. A compressed air passageway 448 can surround the primary combustor 432 and be at least partially defined by the casing 436.

The combustion section 414 further includes a set of secondary combustors 450 comprising an annular mini combustor 434. The annular mini combustor 434 is defined by a secondary combustor liner 452 concentric with respect to the outer liner 440 and the inner liner 442 and annular about the centerline 20. The secondary combustor liner 452 together with the outer liner 440 defines at least a portion of a secondary combustion chamber 454 circumferentially arranged about the centerline 20. The annular mini combustor 434 is open to the primary combustor 432. More specifically, the secondary combustor liner terminates at an end 456 axially downstream from the primary fuel nozzles 430.

The primary combustor 432 produces primary exhaust gasses (denoted "G1") in the primary combustion chamber 446. The set of secondary combustors 450 produce secondary exhaust gasses (denoted "G2") in the secondary combustion chamber 454 that flow into the primary combustion chamber 446. The secondary exhaust gasses G2 circulate in the primary combustion chamber 446 starving $O_2$ levels and reducing temperatures in the primary combustion chamber 446. This results in a reduction of NOx emissions.

It is contemplated that the cross sections illustrated in FIG. 3, FIG. 4, or FIG. 7 can be cross sections of a portion of the combustion section 414. That is, the secondary combustion chamber 54, the forward secondary combustion chamber 254*a*, or the aft secondary combustion chamber 254*b* can be an annular combustion chamber instead of a discrete set of secondary combustion chambers.

In the case of the annular mini combustor 434, circumferential fuel supply can be varied to make portions of the exhaust hotter than the rest to change heat release rates circumferentially. That is, fuel supplied to each secondary fuel nozzle of the set of secondary fuel nozzles, or a cluster of secondary fuel nozzles circumscribing the annular mini combustor 434 are controllable. By controlling the fuel supply circumferentially, temperature can be changed or adjusted at different portions of the annular mini combustor 434. In other words, each secondary fuel nozzle, each cluster of secondary mixer tubes, or each secondary mixer tube are controllable between fuel rich and fuel lean.

Figure 11:
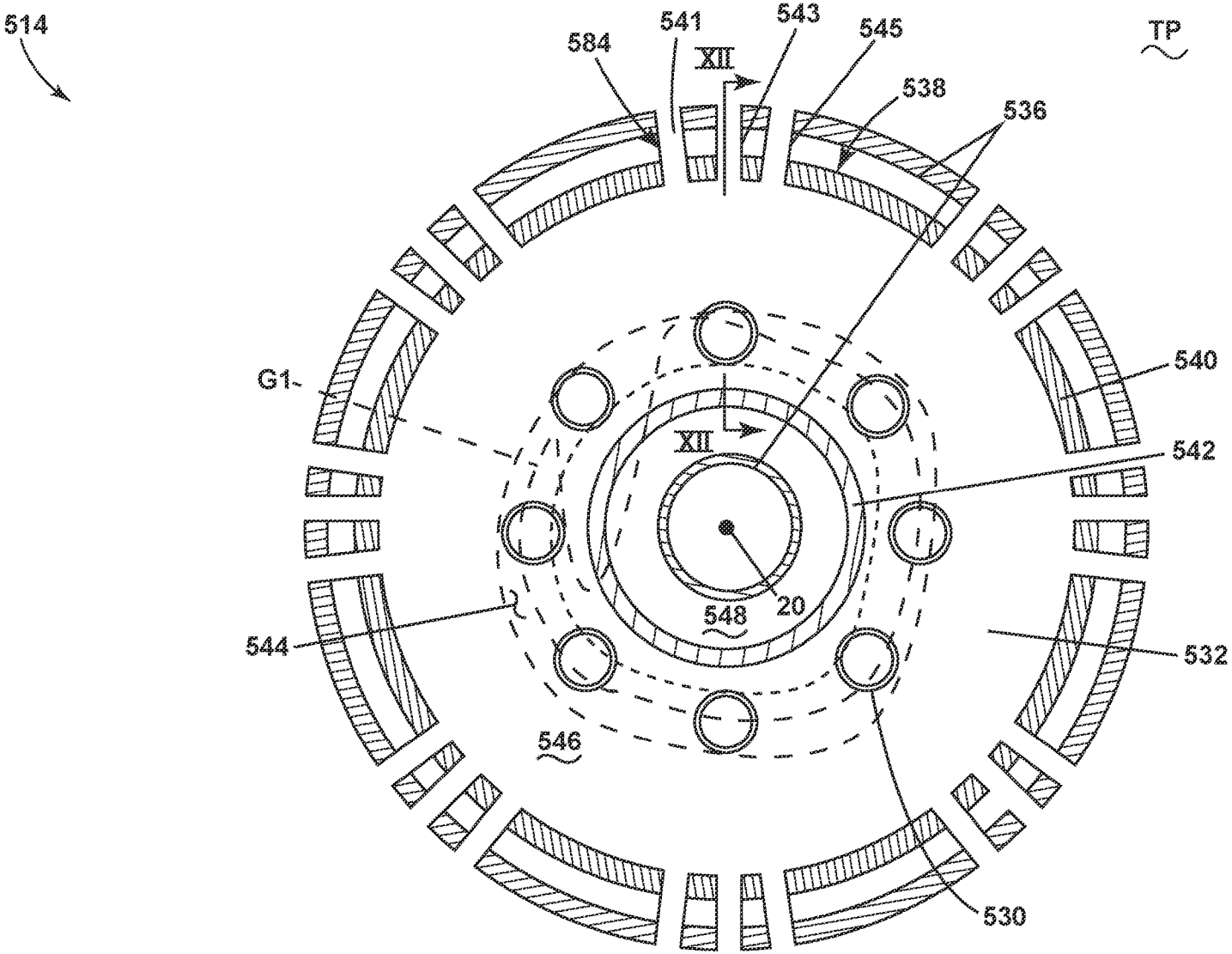
FIG. 11 is a schematic cross-sectional view of yet another embodiment of a combustion section of the turbine engine of FIG. 1 with a primary combustor and a set of secondary combustors according to an aspect of the disclosure herein.

FIG. 11 depicts a cross-sectional view of yet another embodiment of a combustion section 514 as viewed in a transverse plane (denoted "TP"). The combustion section 514 includes an annular arrangement of primary fuel nozzles 530 disposed around the centerline 20 of the turbine engine 10 (FIG. 1). Each of the primary fuel nozzles 530 are fluidly coupled to a primary combustor 532. It should be appreciated that the annular arrangement of fuel nozzles can be one or multiple fuel nozzles and one or more of the primary fuel nozzles 530 can have different characteristics. The primary combustor 532 can have a can, can-annular, or annular arrangement depending on the type of engine in which the primary combustor 532 is located. In a non-limiting example, an annular arrangement is illustrated and disposed within a casing 536. The primary combustor 532 is defined by a primary combustor liner 538 including an outer liner 540 and an inner liner 542 concentric with respect to each other and annular about the centerline 20. A dome wall 544 together with the primary combustor liner 538 define a primary combustion chamber 546 annular about the centerline 20. A compressed air passageway 548 can be located between at least a portion of the casing 536 and the primary combustor 532.

The combustion section 514 further includes a set of secondary fuel nozzles 584 axially downstream from the primary fuel nozzles 530. The set of secondary fuel nozzles 584 include a cluster of mixer tubes illustrated as mixer tubes 541, 543, 545. The mixer tubes 541, 543, 545 are fluidly coupled to the primary combustion chamber 546 at the outer liner 540. The mixer tubes 541, 543, 545 can extend through the casing 536 and the outer liner 540. Alternatively, in another different and non-limiting example, the mixer tubes 541, 543, 545 can be defined by the casing 536. Alternatively, in yet another different and non-limiting example, the mixer tubes 541, 543, 545 can be located within the outer liner 540, wherein air and fuel are provided to the mixer tubes 541, 543, 545 via a conduit (not shown) that passes through the casing 536.

While illustrated as each primary fuel nozzle 530 corresponding to a respective set of secondary fuel nozzles 584, it is contemplated that the set of secondary fuel nozzles 584 can be circumferentially arranged or located at any point of the outer liner 540. That is, in a different and non-limiting example, the set of secondary fuel nozzles 584 can be circumferentially spaced or distributed at equal arclengths about the centerline 20.

The primary combustor 532 produces primary exhaust gasses (denoted "G1") in the primary combustion chamber 546. The set of secondary fuel nozzles 584 produce micro flames in the primary combustion chamber 546. The micro flames consume some of the $O_2$ in the primary combustion chamber 546, reducing the levels $O_2$, resulting in a reduction of NOx emissions.

Figure 12:
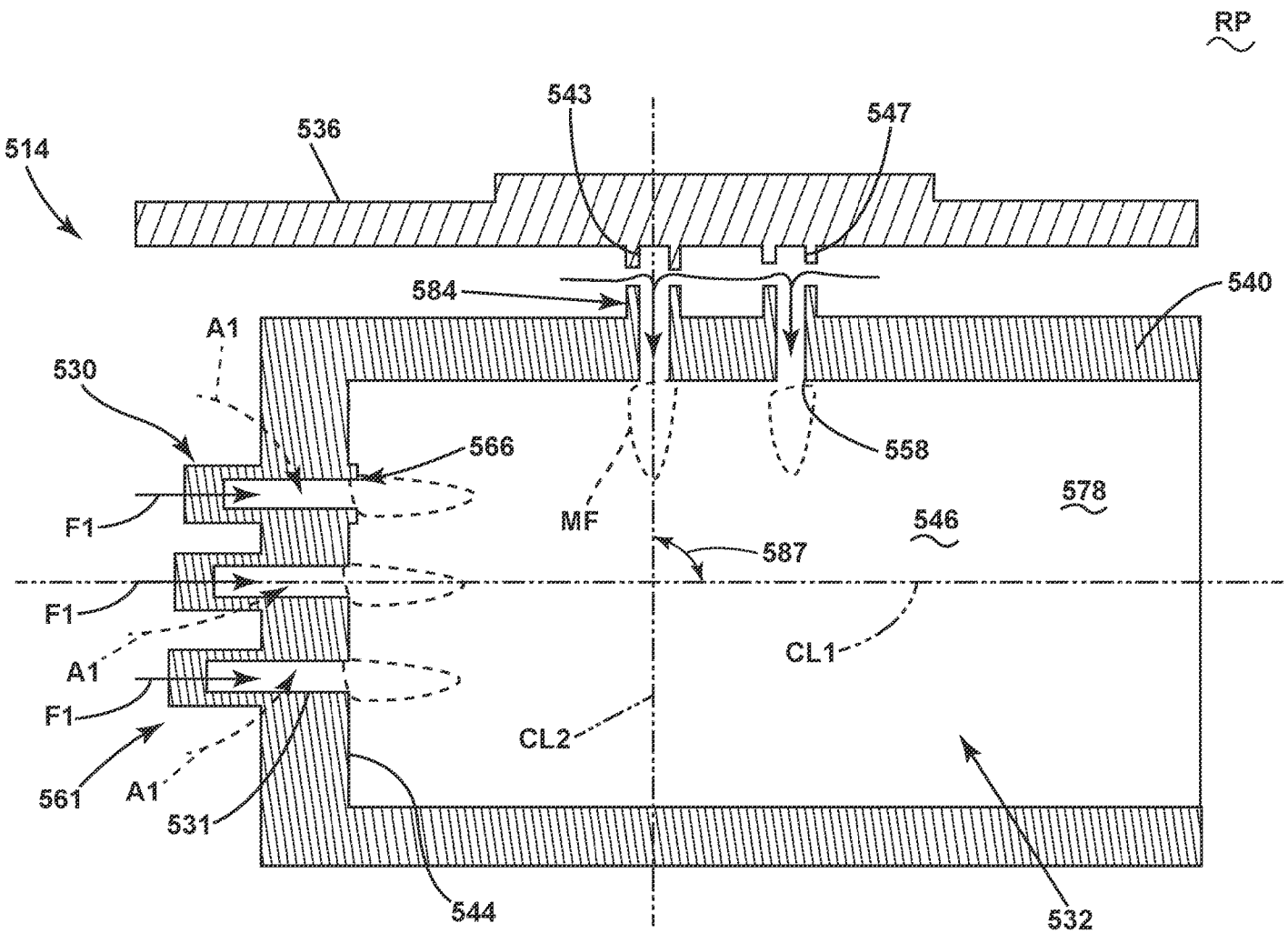
FIG. 12 is a schematic cross-sectional view taken along line XII-XII of FIG. 11 of the primary combustor according to an aspect of the disclosure herein.

FIG. 12 depicts a schematic cross-sectional view taken along line XII-XII of FIG. 11 illustrating the combustion section 514 as viewed in a radial plane (denoted "RP"). It can more clearly be seen that the set of secondary fuel nozzles 584 are open to the primary combustor 532. The primary combustor 532 extends between the dome wall 544 and a primary combustor outlet 578 fluidly coupled to the turbine section 16 (FIG. 1).

A dome assembly 561 includes the dome wall 544 and houses a set of primary fuel nozzles 530. The set of primary fuel nozzles 530 are illustrated, by way of example, as multiple primary mixer tubes 531. The multiple primary mixer tubes 531 can be adapted to receive a primary flow of fuel (denoted "F1") and a primary airflow A1. The set of primary fuel nozzles 530 can terminate in a set of fuel outlets, also referred to herein as a set of dome inlets 566.

By way of non-limiting example, the set of primary fuel nozzles 530 can be one or more of lean cups, rich cups, or pilot tubes.

The set of secondary fuel nozzles 584 are located axially downstream from the dome wall 544. The mixer tube 543 can be upstream or forward of another mixer tube 547 that are part of the cluster of mixer tubes that include at least mixer tubes 541 (FIG. 11), 545 (FIG. 11), 543, 547. The mixer tubes 543, 547 are fluidly coupled to the primary combustion chamber 546 at openings 558 of an outer liner 540 that partially defines the primary combustion chamber 546.

By way of non-limiting example, the set of secondary fuel nozzles 584 can be one or more of lean cups, rich cups, or pilot tubes. The equivalence ratio (phi "Φ") of a combustion system including the primary combustion chamber 546, the set of primary fuel nozzles 530, and the set of secondary fuel nozzles 584 can be in a range from 0.4 to 2.

The set of secondary fuel nozzles 584 produce micro flames (denoted "MF") in the primary combustion chamber 546. The micro flames MF consume some of the $O_2$ in the primary combustion chamber 546, reducing the levels $O_2$, resulting in a reduction of NOx emissions.

The set of dome inlets 566 define a first centerline (denoted "CL1"). One or more of the openings 558 fluidly coupling one of the set of secondary fuel nozzles 584 to the primary combustor 532 can define a second centerline CL2. The first centerline CL1 and the second centerline CL2 intersect to define an angle 587 in the radial plane RP. The angle 587 can be 90° as illustrated. While illustrated as a 90-degree angle, it is contemplated that in a different and non-liming example, that the angle 587 can vary from 30° to 150°, as further illustrated in FIG. 13.

Figure 13:
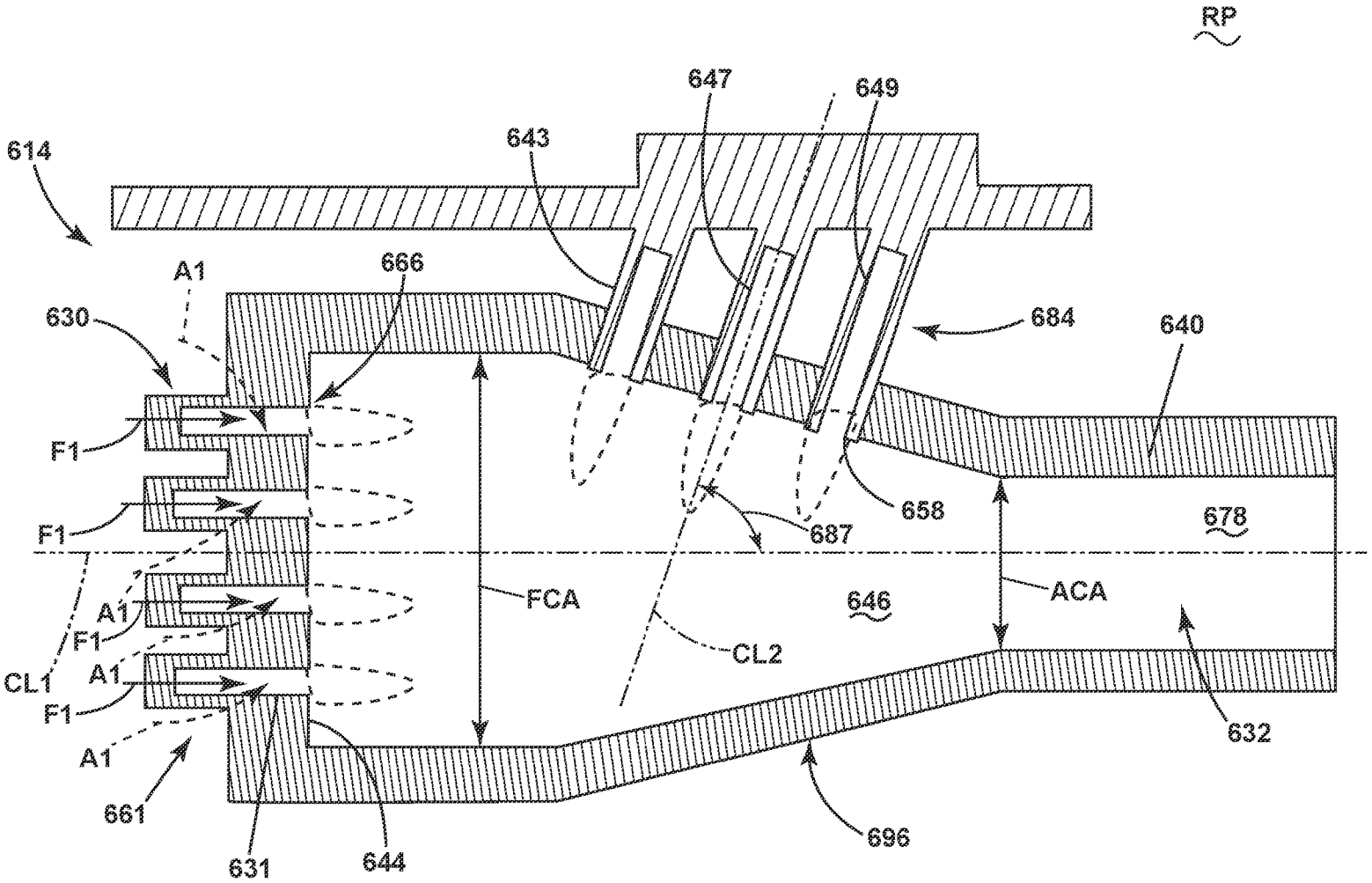
FIG. 13 is a schematic cross-sectional view of another embodiment of primary combustor of FIG. 11 according to an aspect of the disclosure herein.

FIG. 13 depicts a schematic cross-sectional view of another embodiment of a combustion section 614 as viewed in a radial plane (denoted "RP"). The combustion section 614 is similar to the combustion section 514 of FIG. 12, therefore like parts will be identified with like numerals further increased by 100, with it being understood that the description of the like parts of the combustion section 514 applies to the combustion section 614, except where noted.

A primary combustor 632 extends between the dome wall 644 and a primary combustor outlet 678 fluidly coupled to the turbine section 16 (FIG. 1). A dome assembly 661 includes the dome wall 644 and houses a set of primary fuel nozzles 630. The set of primary fuel nozzles 630 are illustrated, by way of example, as multiple primary mixer tubes 631. The multiple primary mixer tubes 631 can be adapted to receive a primary flow of fuel (denoted "F1") and a primary airflow A1. The set of primary fuel nozzles 630 can terminate in a set of fuel outlets, also referred to herein as a set of dome inlets 666. By way of non-limiting example, the set of primary fuel nozzles 630 can be one or more of lean cups, rich cups, or pilot tubes.

A set of secondary fuel nozzles 684 are located axially downstream from the dome wall 644. The set of secondary fuel nozzles 684 can be mixer tubes 643, 647, 649 that are part of the cluster of mixer tubes. The mixer tubes 643, 647, 649 are fluidly coupled to a primary combustion chamber 646 at openings 658 of an outer liner 640 that partially defines the primary combustion chamber 646. By way of non-limiting example, the set of secondary fuel nozzles 684 can be one or more of lean cups, rich cups, or pilot tubes.

It is contemplated that the primary combustor 632 includes a gradually converging body 696. The gradually converging body 696 is defined as a portion of the primary combustor 632 where a forward cross-sectional area (denoted "FCA") is greater than an aft cross-sectional area (denoted "ACA"). The forward cross-sectional area FCA can be measured proximate the dome wall 644 or upstream of the set of secondary fuel nozzles 684. The aft cross-sectional area ACA can be measured downstream of the set of secondary fuel nozzles 684 or proximate the primary combustor outlet 678.

The set of dome inlets 666 define a first centerline (denoted "CL1"). The openings 658 can define a second centerline (denoted "CL2"). The first centerline CL1 and the second centerline CL2 intersect to define an angle in the radial plane RP. The angle can be less than 90° as illustrated. While illustrated as less than 90°, it is contemplated in a different and non-limiting example, that the angle 687 can be in a range from 30° to 150°.

Benefits of the angle 687 being different than 90° can include increase in turbulation of the air in the primary combustor 632, further reducing the $O_2$ in the primary combustion chamber 646.

Benefits of the gradually converging body 696 includes reducing residence time of the combustion section 614 which helps to reduce NOx emission. Furthermore, converging the primary combustor 632 helps to penetrate the exhaust from the set of secondary fuel nozzles 684 (or a secondary combustor) to the middle of the primary combustor 632. Having less height to penetrate to reach middle of the primary combustor 632 thereby achieves the desired mixing of the secondary exhaust gasses G2 (FIG. 2 or FIG. 11) from the set of secondary fuel nozzles 684 (or the secondary combustor) with bulk flow or the primary exhaust gasses G1 (FIG. 2 or FIG. 11) in the primary combustion chamber 646.

Benefits associated with the set of secondary combustors in combination with the primary combustor and methods described herein are to reduce NOx emissions even in a severe cycle with a higher operating air pressure, higher temperature, higher fuel/air ratio and with heated fuel. Typically, higher fuel/air ratio within a combustion system leads to a higher flame temperature which results in higher NOx. By having two combustion chambers within the combustion system, fuel can be split between these chambers thereby reducing the fuel/air ratio in each chamber and in turn achieving lower temperature and hence lower NOx emission. By directing product of combustion from a secondary combustion into a primary combustion chamber, $O_2$ levels in the primary combustion chamber can be reduced, further reducing NOx emission. The combustions section herein can operate with 100% $H_2$ fuel.

The set of secondary fuel nozzles create smaller compact flame structures in the secondary combustor that helps to reduce length of the secondary combustor. Smaller multiple compact flame structures also reduces NOx. The set of secondary fuel nozzles distribute uniform temperature created by multiple flames and carbon emission, where smaller flames have higher lengths available post flame for CO burn out.

While described with respect to a turbine engine, it should be appreciated that the combustor as described herein can be for any engine having a combustor that emits NOx. It should be appreciated that application of aspects of the disclosure discussed herein are applicable to engines with propeller sections or fan and booster sections along with turbojets and turbo engines as well.

To the extent not already described, the different features and structures of the various embodiments can be used in combination, or in substitution with each other as desired. That one feature is not illustrated in all of the embodiments is not meant to be construed that it cannot be so illustrated, but is done for brevity of description. Thus, the various features of the different embodiments can be mixed and matched as desired to form new embodiments, whether or not the new embodiments are expressly described. All combinations or permutations of features described herein are covered by this disclosure.

This written description uses examples to describe aspects of the disclosure described herein, including the best mode, and also to enable any person skilled in the art to practice aspects of the disclosure, including making and using any devices or systems and performing any incorporated methods. The patentable scope of aspects of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Further aspects are provided by the subject matter of the following clauses:

A combustion section for a turbine engine, the combustion section comprising a primary combustor liner including an inner liner and an outer liner, a dome wall extending between the inner liner and the outer liner, a primary combustion chamber defined at least in part by the inner liner, the outer liner, and the dome wall, wherein the outer liner defines at least one opening aft of the dome wall, a primary fuel nozzle having an outlet at the dome wall, wherein the outlet of the primary fuel nozzle is fluidly coupled with the primary combustion chamber, a secondary combustion chamber defined at least in part by a secondary combustor liner, the secondary combustion chamber fluidly coupled to the primary combustion chamber at the at least one opening, and a set of secondary fuel nozzles comprising multiple mixer tubes having outlets at the secondary combustor liner, wherein the outlets of the mixer tubes are fluidly coupled with the secondary combustion chamber.

A combustion section for a turbine engine, the combustion section comprising a primary combustor liner including an inner liner and an outer liner, a dome wall extending between the inner liner and the outer liner, a primary combustion chamber defined at least in part by the inner liner, the outer liner, and the dome wall, wherein the outer liner defines at least one opening aft of the dome wall, a primary fuel nozzle having an outlet at the dome wall, wherein the outlet of the primary fuel nozzle is fluidly coupled with the primary combustion chamber, and a set of secondary fuel nozzles comprising annularly spaced clusters of mixer tubes having outlets at the outer liner, wherein the outlets of the mixer tubes are fluidly coupled with the primary combustion chamber.

The combustion section of any preceding clause, wherein at least one mixer tube of the multiple mixer tubes is a pilot tube.

The combustion section of any preceding clause, wherein the primary fuel nozzle is a plurality of primary fuel nozzles.

The combustion section of any preceding clause, wherein the plurality of primary fuel nozzles includes multiple primary mixer tubes, and wherein at least one primary mixer tube is a pilot tube.

The combustion section of any preceding clause, wherein the plurality of primary fuel nozzle includes at least one rich fuel cup.

The combustion section of any preceding clause, wherein the plurality of primary fuel nozzles includes at least one lean fuel cup.

The combustion section of any preceding clause, wherein the primary fuel nozzle includes at least one cup controllable between a rich fuel cup and a lean fuel cup.

The combustion section of any preceding clause, wherein each primary fuel nozzle of the plurality of primary fuel nozzles includes at least one cup controllable between a rich fuel cup and a lean fuel cup.

The combustion section of any preceding clause, wherein the at least one opening is defined by the secondary combustor liner.

The combustion section of any preceding clause, wherein the secondary combustion chamber is a set of circumferentially spaced combustion chambers and the at least one opening is a plurality of circumferentially spaced openings, where each secondary combustion chamber of the set of circumferentially combustion chambers fluidly couples to the primary combustion chamber at each opening of the plurality of circumferentially spaced openings.

The combustion section of any preceding clause, wherein the secondary combustion chamber is an annular combustion chamber defined in part by the outer liner.

The combustion section of any preceding clause, wherein a cluster of secondary mixer tubes are circumferentially spaced about the annular combustion chamber.

The combustion section of any preceding clause, wherein the cluster of secondary mixer tubes are controllable between fuel rich and fuel lean.

The combustion section of any preceding clause, wherein a first centerline defined by the primary fuel nozzle overlaps with a second centerline defined by the at least one opening.

The combustion section of any preceding clause, wherein a primary combustor defined by the primary combustion chamber and the primary fuel nozzles is a rich burn system.

The combustion section of any preceding clause, wherein the secondary combustion chamber is a plurality of secondary combustion chambers, and a set of secondary combustors are defined by the plurality of secondary combustion chambers and the set of secondary fuel nozzles is a lean burn system.

The combustion section of any preceding clause, wherein a primary combustor defined by the primary combustion chamber and the primary fuel nozzles are a lean burn system, and wherein a set of secondary combustors defined by the secondary combustion chambers and set of secondary fuel nozzles are a rich burn system.

The combustion section of any preceding clause, wherein a primary combustor defined by the primary combustion chamber and the primary fuel nozzles are a lean burn system, and wherein a set of secondary combustors defined by the secondary combustion chambers and set of secondary fuel nozzles are a lean burn system.

The combustion section of any preceding clause, wherein each secondary combustor of the set of secondary combustors is controllable a rich burn combustion system and a lean burn combustion system.

The combustion section of any preceding clause, wherein the set of secondary combustors is controllable a rich burn combustion system and a lean burn combustion system.

The combustion section of any preceding clause, wherein the multiple mixer tubes form a cluster of mixer tubes.

The combustion section of any preceding clause, wherein the primary combustion chamber includes a primary combustor length measured from the dome wall to a primary combustor outlet and a primary combustion height measured radially across the primary combustion chamber from the inner liner to the outer liner, wherein the primary combustion height is in a range from 1.1 to 10 times a dome inlet diameter measured across the dome inlet.

The combustion section of any preceding clause, wherein the at least one opening is located at an end of the secondary combustion chamber, where the end is an axial distance from the dome wall, and wherein the axial distance is in a range of 0% to 70% of the primary combustor length.

The combustion section of any preceding clause, wherein the primary combustion chamber includes a primary outlet centerline defined by the primary combustor outlet, and wherein a radially distance between the at least one opening and the primary outlet centerline is in a range of 30% to 100% of the primary combustion height.

The combustion section of any preceding clause, wherein the primary fuel nozzle defines a rich cup and a cluster of secondary mixer tubes define a plurality of lean cups.

The combustion section of any preceding clause, wherein the secondary combustion chamber is a set of secondary combustion chambers having a forward secondary combustion chamber and an aft secondary combustion chamber, axially spaced from the forward secondary combustion chamber.

The combustion section of any preceding clause, wherein the aft secondary combustion chamber fluidly couples to the primary combustion chamber at an aft opening and the forward secondary combustion chamber fluidly couples to the primary combustion chamber at a forward opening.

The combustion section of any preceding clause, wherein the forward opening and the aft opening axially align.

The combustion section of any preceding clause, wherein the first centerline CL1 passes through at least a portion of the forward opening or the aft opening.

The combustion section of any preceding clause, wherein the forward opening and the aft opening are axially offset from each other.

A turbine engine comprising a compressor section, a combustion section, and a turbine section in serial flow arrangement along an engine centerline, the combustion section comprising a primary combustor liner including an inner liner and an outer liner, a dome wall extending between the inner liner and the outer liner, a primary combustion chamber defined at least in part by the inner liner, the outer liner, and the dome wall, a primary fuel nozzle having an outlet at the dome wall, wherein the outer liner defines at least one opening aft of the dome wall, wherein the outlet of the primary fuel nozzle is fluidly coupled with the primary combustion chamber, a secondary combustion chamber defined at least in part by a secondary combustor liner, the secondary combustion chamber fluidly coupled to the primary combustion chamber at the at least one opening, and a set of secondary fuel nozzles comprising multiple mixer tubes having outlets at the secondary combustor liner, wherein the outlets of the mixer tubes are fluidly coupled with the secondary combustion chamber.

The turbine engine of any preceding clause, wherein the secondary combustion chamber extends from the outer liner in a radially outward direction.

The turbine engine of any preceding clause, where the primary fuel nozzle defines a first mixer tube centerline and the opening defines a second centerline, wherein an angle between the first mixer tube centerline and the second centerline is in a range from 30 degrees to 150 degrees.

The turbine engine of any preceding clause, wherein the primary combustion chamber or the secondary combustion chamber have a phi (equivalence ratio) in a range from 0.4 to 2.

The turbine engine of any preceding clause, wherein the primary combustion chamber and the secondary combustion chamber have a phi (equivalence ratio) in a range from 0.4 to 2.

What is claimed is:

1. A combustion section for a turbine engine, the combustion section comprising:

a primary combustor liner including an inner liner and an outer liner;

a dome wall extending between the inner liner and the outer liner;

a primary combustion chamber defined at least in part by the inner liner, the outer liner, and the dome wall, wherein the outer liner defines at least one opening aft of the dome wall;

a primary fuel nozzle having an outlet at the dome wall, wherein the outlet of the primary fuel nozzle is fluidly coupled with the primary combustion chamber;

a secondary combustion chamber defined at least in part by a secondary combustor liner, the secondary combustion chamber fluidly coupled to the primary combustion chamber at the at least one opening;

a set of secondary fuel nozzles comprising multiple mixer tubes having outlets at the secondary combustor liner, wherein the outlets of the mixer tubes are fluidly coupled with the secondary combustion chamber;

a first igniter at least partially located in the primary combustion chamber; and a second igniter at least partially located in the secondary combustion chamber.

2. The combustion section of claim 1, wherein at least one mixer tube of the multiple mixer tubes is a pilot tube.

3. The combustion section of claim 1, wherein the secondary combustion chamber is a set of circumferentially spaced combustion chambers and the at least one opening is a plurality of circumferentially spaced openings, where each secondary combustion chamber of the set of circumferentially combustion chambers fluidly couples to the primary combustion chamber at each opening of the plurality of circumferentially spaced openings.

4. The combustion section of claim 1, wherein the secondary combustion chamber is an annular combustion chamber defined in part by the outer liner.

5. The combustion section of claim 4, wherein a cluster of secondary mixer tubes are circumferentially spaced about the annular combustion chamber.

6. The combustion section of claim 1, wherein a first centerline defined by the primary fuel nozzle intercepts with a second centerline defined by the at least one opening.

7. The combustion section of claim 1, wherein a primary combustor defined by the primary combustion chamber and the primary fuel intercepts is a rich burn system.

8. The combustion section of claim 7, wherein the secondary combustion chamber is a plurality of secondary combustion chambers, and a set of secondary combustors are defined by the plurality of secondary combustion chambers and the set of secondary fuel nozzles is a lean burn system.

9. The combustion section of claim 1, wherein the multiple mixer tubes form a cluster of mixer tubes.

10. The combustion section of claim 1, wherein the primary combustion chamber includes a primary combustor length measured from the dome wall to a primary combustor outlet and a primary combustion height measured radially across the primary combustion chamber from the inner liner to the outer liner, wherein the primary combustion height is in a range from 1.1 to 10 times a dome inlet diameter measured across a dome inlet.

11. The combustion section of claim 10, wherein the at least one opening is located at an end of the secondary combustion chamber, where the end is an axial distance from the dome wall, and wherein the axial distance is in a range of 0% to 70% of the primary combustor length.

12. The combustion section of claim 10, wherein the primary combustion chamber includes a primary outlet centerline defined by the primary combustor outlet, and wherein a radially distance between the at least one opening and the primary outlet centerline is in a range of 30% to 100% of the primary combustion height.

13. The combustion section of claim 1, wherein the primary fuel nozzle defines a rich cup and a cluster of secondary mixer tubes define a plurality of lean cups.

14. The turbine engine of claim 1, further comprising dilution openings located downstream from the secondary combustion chamber in the outer liner or the inner liner.

15. A turbine engine comprising:

a compressor section, a combustion section, and a turbine section in serial flow arrangement along an engine centerline, the combustion section comprising:

a primary combustor liner including an inner liner and an outer liner;

a dome wall extending between the inner liner and the outer liner;

a primary combustion chamber defined at least in part by the inner liner, the outer liner, and the dome wall, wherein the outer liner defines at least one opening aft of the dome wall;

a primary fuel nozzle having an outlet at the dome wall, wherein the outlet of the primary fuel nozzle is fluidly coupled with the primary combustion chamber;

a secondary combustion chamber defined at least in part by a secondary combustor liner, the secondary combustion chamber fluidly coupled to the primary combustion chamber at the at least one opening; and a set of secondary fuel nozzles comprising multiple mixer tubes having outlets at the secondary combustor liner, wherein the outlets of the mixer tubes are fluidly coupled with the secondary combustion chamber, and wherein each fuel nozzle of the set of secondary fuel nozzles contributes to a flame of a plurality of flames located, at least in part, in the secondary combustion chamber.

16. The turbine engine of claim 15, wherein the secondary combustion chamber extends from the outer liner in a radially outward direction.

17. The turbine engine of claim 15, wherein the primary combustion chamber or the secondary combustion chamber have a phi (equivalence ratio) in a range from 0.4 to 2.

18. The turbine engine of claim 15, wherein the plurality of flames are a cluster or array of micro flames.

19. The combustion section of claim 15, wherein at least one mixer tube of the multiple mixer tubes is a pilot tube.

20. The combustion section of claim 15, wherein the multiple mixer tubes form a cluster of mixer tubes.

* * * * *